US010276950B1

(12) United States Patent
Amini et al.

(10) Patent No.: US 10,276,950 B1
(45) Date of Patent: Apr. 30, 2019

(54) COMBINED POWER AND DATA CONNECTOR SYSTEM

(71) Applicants: Mahmoud R. Amini, Sunnyvale, CA (US); Peter J. Cameron, Sunnyvale, CA (US); Venus Kumar, Sunnyvale, CA (US); Neven Pischl, Sunnyvale, CA (US); Abhilash Rajagopal, Sunnyvale, CA (US)

(72) Inventors: Mahmoud R. Amini, Sunnyvale, CA (US); Peter J. Cameron, Sunnyvale, CA (US); Venus Kumar, Sunnyvale, CA (US); Neven Pischl, Sunnyvale, CA (US); Abhilash Rajagopal, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/712,743

(22) Filed: Sep. 22, 2017

Related U.S. Application Data

(60) Provisional application No. 62/398,816, filed on Sep. 23, 2016.

(51) Int. Cl.

| | |
|---|---|
| ***H01R 13/648*** | (2006.01) |
| ***H01R 9/05*** | (2006.01) |
| ***H01R 13/52*** | (2006.01) |
| ***H01R 13/658*** | (2011.01) |

(52) U.S. Cl.
CPC ..... *H01R 9/0512* (2013.01); *H01R 13/5219* (2013.01); *H01R 13/658* (2013.01)

(58) Field of Classification Search
CPC . H01R 9/0512; H01R 13/658; H01R 13/5219
USPC .. 439/540.1, 578, 101, 108, 607.23, 607.24, 439/607.25, 607.26, 924.1
See application file for complete search history.

(56) References Cited

U.S. PATENT DOCUMENTS

| | | | | |
|---|---|---|---|---|
| 3,980,373 A * | 9/1976 | McCormick | H01R 13/625 | 285/319 |
| 4,679,013 A * | 7/1987 | Farrar | H03H 1/0007 | 333/182 |
| 4,758,536 A * | 7/1988 | Miller | H01R 13/4536 | 439/138 |
| 5,575,690 A | 11/1996 | Eaton | | |

(Continued)

*Primary Examiner* — Abdullah A Riyami
*Assistant Examiner* — Nelson R. Burgos-Guntin
(74) *Attorney, Agent, or Firm* — Young Basile Hanlon & MacFarlane, P.C.

(57) ABSTRACT

A connector system for transferring electricity and data. The connector system includes a receptacle and a plug. The receptacle includes a shield, a power contact, a ground contact, and a data contact. The shield includes power apertures through which power conductor segments of the power contact extend, ground apertures through which ground conductor segments of the ground contact extend, and a data aperture through which a shield member and a data conductor of the data contact extend. The plug includes another power contact connected to a power wire, another ground contact connected to a ground wire, and another data contact. The plug is receivable by the receptacle to electrically connect the power wire conductor to the power conductor segments of the receptacle, to electrically connect the ground wire conductor to the ground conductor segments of the receptacle, and to electrically connect the data contact to the other data contact, respectively.

27 Claims, 21 Drawing Sheets

(56) References Cited

U.S. PATENT DOCUMENTS 5,876,248 A * 3/1999 Brunker ..... H01R 23/688 439/607.08
5,982,253 A 11/1999 Perrin et al.
6,379,183 B1 * 4/2002 Ayres ..... H01R 9/0515 439/578
6,592,409 B1 7/2003 Oehme et al.
7,074,085 B2 7/2006 Chen
7,195,505 B1 * 3/2007 Becker ..... H01R 13/5219 439/271
7,722,259 B2 * 5/2010 Smith, III ..... G02B 6/3817 385/53
7,794,274 B2 9/2010 Phillips, Jr.
8,303,337 B2 11/2012 Ballard et al.
8,450,610 B2 * 5/2013 Alvelo ..... H01B 7/18 174/84 R
8,460,029 B1 * 6/2013 Chen ..... H01R 13/659 439/540.1
8,523,609 B2 * 9/2013 Roman, Jr. ..... H01R 13/5808 439/578
8,562,375 B2 * 10/2013 Chen ..... H01R 13/518 439/488
8,597,036 B2 * 12/2013 Fogg ..... H01R 12/724 439/101
8,715,016 B2 5/2014 DeBock et al.
8,721,364 B2 * 5/2014 Lai ..... H01R 27/02 439/540.1
8,790,136 B2 7/2014 Duesterhoeft
8,864,523 B2 * 10/2014 Banakis ..... H01R 13/6585 439/607.25
8,946,934 B2 2/2015 Butts et al.
9,022,813 B2 5/2015 Wilkner
9,419,366 B2 8/2016 Barrefelt et al.
2003/0207603 A1 * 11/2003 Potega ..... H01R 24/58 439/218
2003/0216149 A1 11/2003 Edwards et al.
2004/0127099 A1 * 7/2004 Lin ..... H01R 13/514 439/607.51
2005/0048846 A1 3/2005 Suzuki et al.
2007/0212936 A1 * 9/2007 Eckel ..... H01R 24/38 439/578
2008/0003881 A1 * 1/2008 Wu ..... H01R 13/5808 439/607.41
2008/0261458 A1 * 10/2008 Eckel ..... H01R 13/5202 439/709
2009/0042448 A1 * 2/2009 He ..... H01R 13/658 439/650
2009/0117785 A1 * 5/2009 Wu ..... H01R 24/62 439/668
2010/0029113 A1 * 2/2010 Smith, III ..... H01R 4/625 439/271
2010/0267270 A1 * 10/2010 Jehmlich ..... H01R 13/42 439/357
2010/0319956 A1 * 12/2010 Ballard ..... B60R 16/0207 174/105 R
2011/0065315 A1 * 3/2011 Xuan ..... H01R 13/506 439/540.1
2011/0201228 A1 * 8/2011 Schumacher ..... H01R 13/4368 439/374
2012/0129397 A1 * 5/2012 Chen ..... H01R 13/514 439/607.24
2015/0004845 A1 1/2015 Barrefelt et al.
2015/0118902 A1 * 4/2015 Data ..... H01R 13/6315 439/587
2015/0200493 A1 * 7/2015 Gao ..... H01R 13/6582 439/607.28
2015/0364870 A1 * 12/2015 Yang ..... H01R 13/659 439/607.25

* cited by examiner

COMBINED POWER AND DATA CONNECTOR SYSTEM

CROSS-REFERENCE TO RELATED APPLICATION(S)

This application claims priority to and the benefit of U.S. Provisional Application No. 62/398,816, filed Sep. 23, 2016, the entire disclosure of which is incorporated by reference herein.

TECHNICAL FIELD

This disclosure relates to electrical connectors and, in particular, connector systems for forming both power and data connections.

SUMMARY

According to an exemplary embodiment, a connector system includes a receptacle assembly and a plug assembly. The receptacle assembly is configured to receive the plug assembly to form separate electrical connections to form a data pathway and a power pathway. The receptacle includes an electromagnetic shield structure that the data pathway and the power pathway pass through and are electrically insulated therefrom.

According to another exemplary embodiment, a connector system provides power and data coupling. The connector system includes a cable, a plug connector, and a base. The cable includes a data conductor, a shielding layer, a first power conductor, and a second power conductor. The plug connector is mechanically coupled to the cable, and includes a data terminal, a first annular member, a first power terminal, and a second power terminal, which are electrically coupled to the data conductor, the shielding layer, the first power conductor, and the second power conductor of the cable, respectively. The annular member is positioned radially between the first power terminal and the second power terminal, and the data terminal is positioned within the annular member. The base is configured to receive the plug connector, and includes a shield structure defining a cavity. The base includes a second data terminal, a second annular member, a third power terminal, and a fourth power terminal, which are positioned in the cavity and are configured to electrically couple to the first data terminal, the first annular member, the first power terminal, and the second power terminal of the plug connector, respectively.

According to another exemplary embodiment, a connector system for transferring electricity and data. The connector system includes a receptacle and a plug. The receptacle includes a shield, a power contact, a ground contact, and a data contact. The shield includes power apertures through which power conductor segments of the power contact extend, ground apertures through which ground conductor segments of the ground contact extend, and a data aperture through which a shield member and a data conductor of the data contact extend. The plug includes another power contact connected to a power wire, another ground contact connected to a ground wire, and another data contact. The plug is receivable by the receptacle to electrically connect the power wire conductor to the power conductor segments of the receptacle, to electrically connect the ground wire conductor to the ground conductor segments of the receptacle, and to electrically connect the data contact to the other data contact, respectively.

A connector system is provided for transferring electricity and data, and includes a receptacle assembly and a plug assembly. The receptacle assembly includes a housing, a shield plate, a power contact, a ground contact, and a data contact. The shield plate is connected to the housing and includes multiple power apertures through which the power contact extends, multiple ground apertures through which the ground contact extends, and a data aperture through which the data contact extends. The plug assembly includes another housing, another power contact, another ground contact, and another power contact in the other housing. The plug is receivable by the receptacle assembly to form a seal therebetween, to electrically connect the other power contact to the power contact, the other ground contact to the ground contact, and the other data contact to the data contact. The receptacle assembly is configured to connect to an electromagnetic shield enclosure to form a seal therewith and to electrically connect the shield plate thereto.

DETAILED DESCRIPTION

Figure 1:
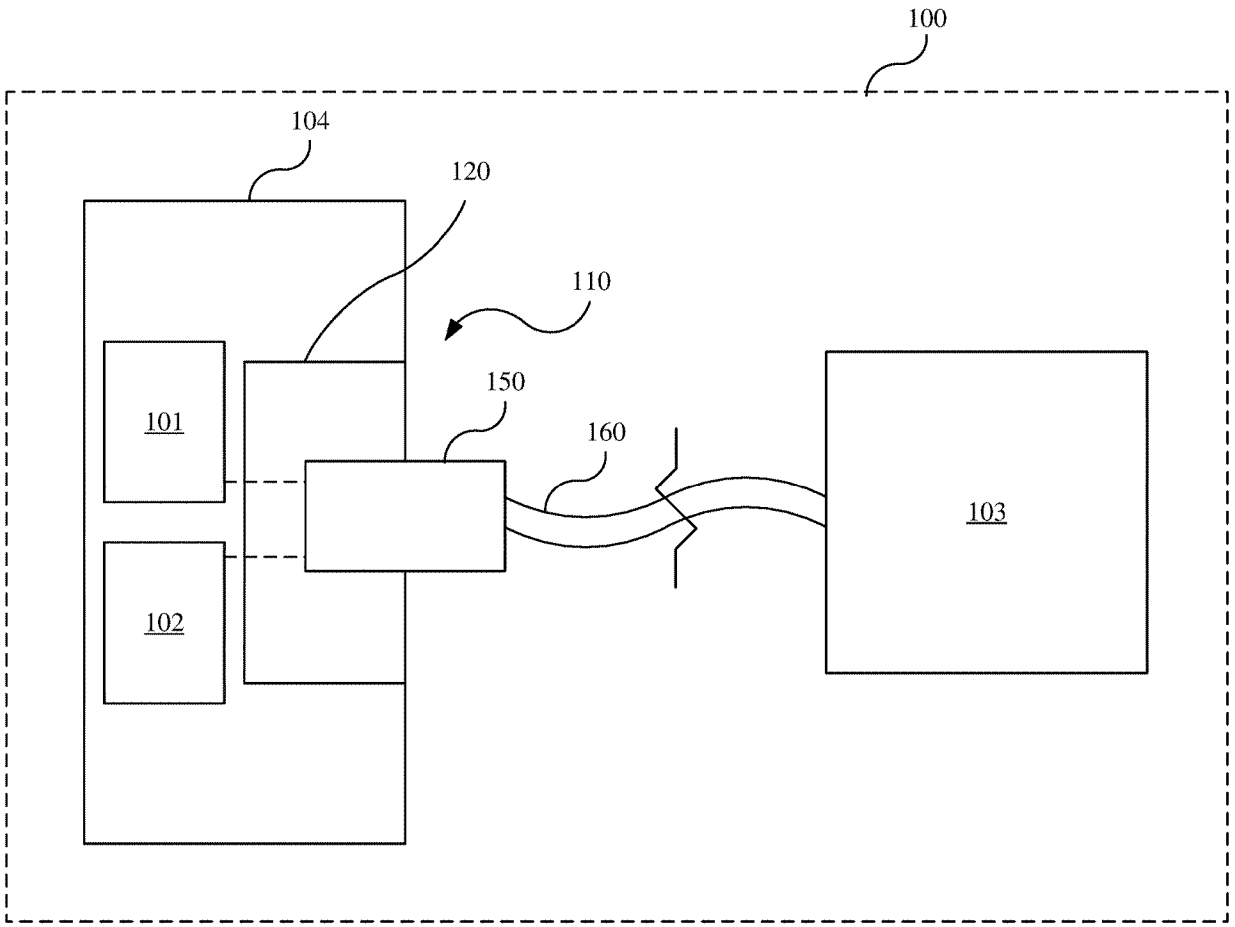
FIG. 1 is a schematic view of a passenger vehicle having a connector system according to an exemplary embodiment.

Referring to FIG. 1, a connector system 110 is configured to transfer both electrical power and signals (e.g., control and data signals) between a power source 101 and a controller 102 and a module 103 located remotely thereto. The power source 101 and/or the controller 102 may be positioned in an enclosure 104 to which the connector system 110 is coupled. The connector system generally includes a receptacle assembly 120 (e.g., receiver, base, female assembly, female connector, etc.) and a plug assembly 150 (e.g., plug connector, male assembly, male connector, etc.) mechanically and electrically connected to a cable 160. The connector system 110 may, for example, be used in a passenger vehicle 100, or other application.

Figure 2:
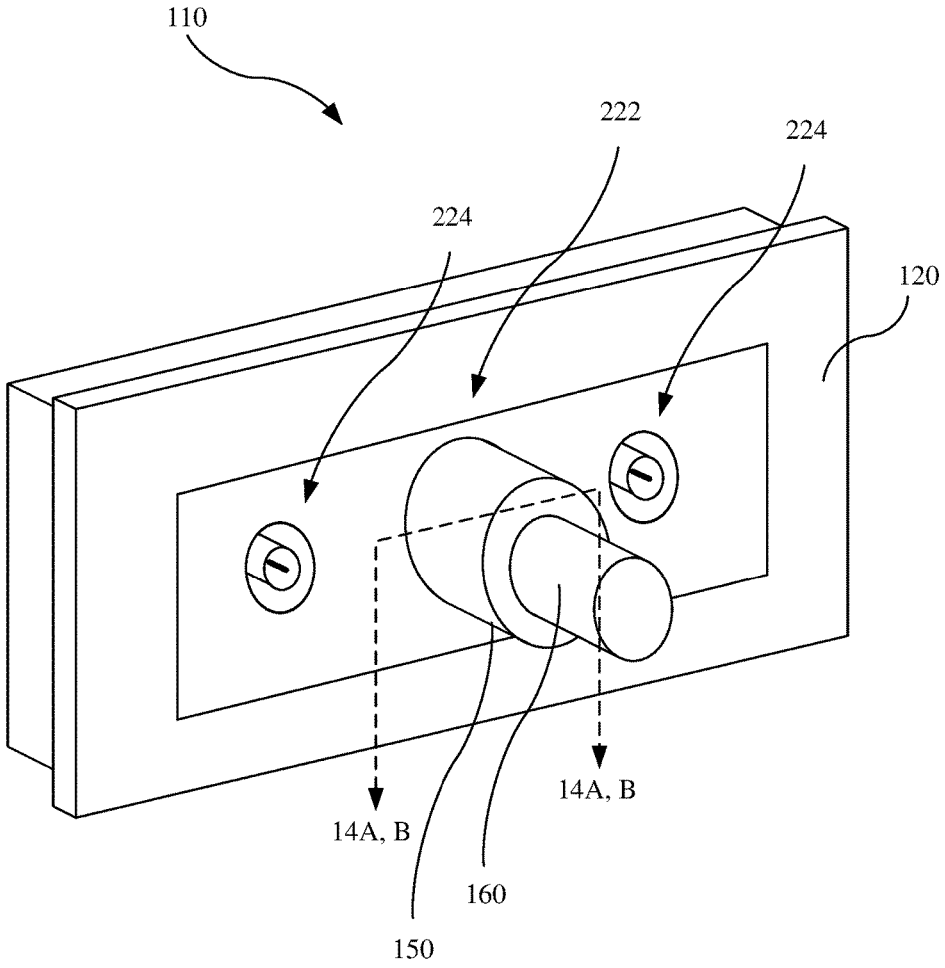
FIG. 2 is an upper, front, left perspective view of the connector system of FIG. 1.
Figure 3:
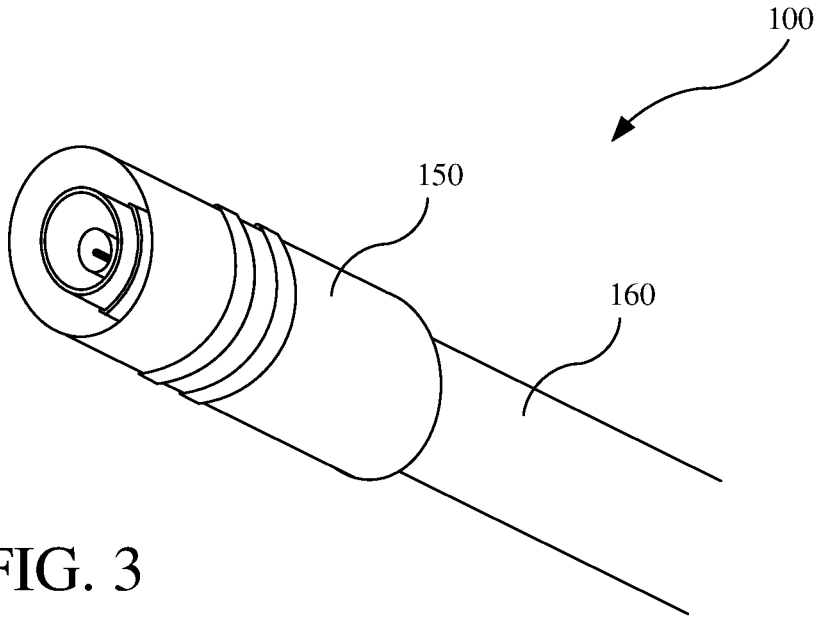
FIG. 3 is an upper, front right perspective view of a plug and a cable of the exemplary connector system shown in FIG. 2.
Figure 4:
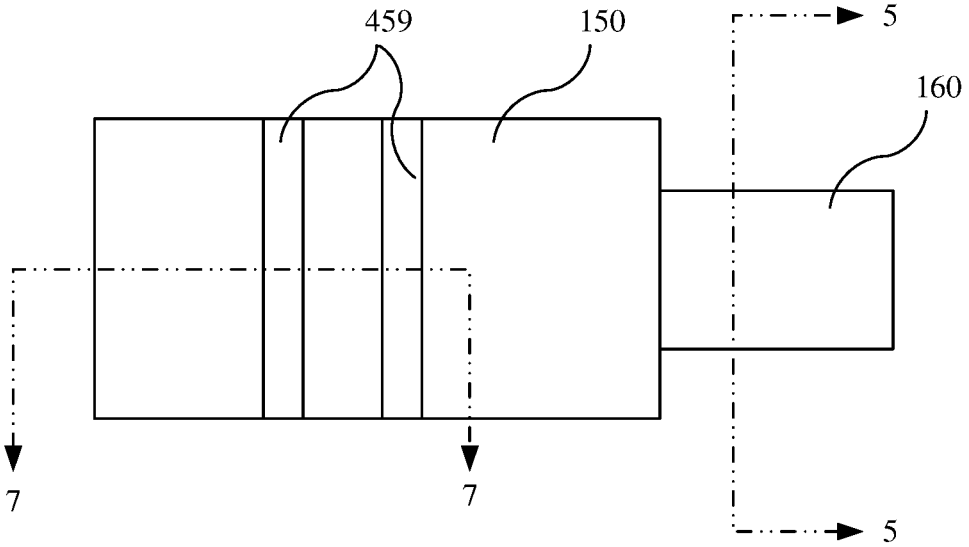
FIG. 4 top plan view of the plug and the cable shown in FIG. 3.
Figure 16:
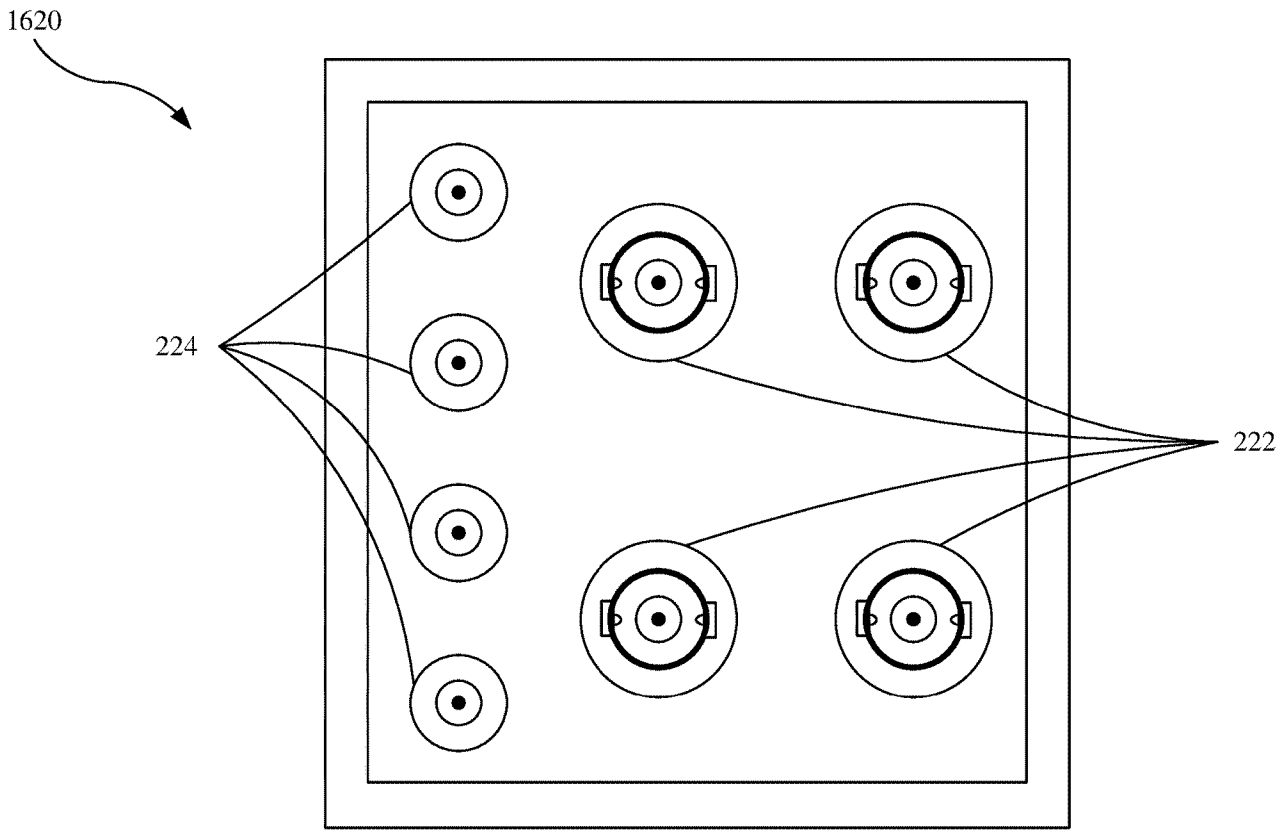
FIG. 16 is a front view of another receptacle assembly having multiple combined power/data connection points and multiple data-only connection points.
Figure 17A:
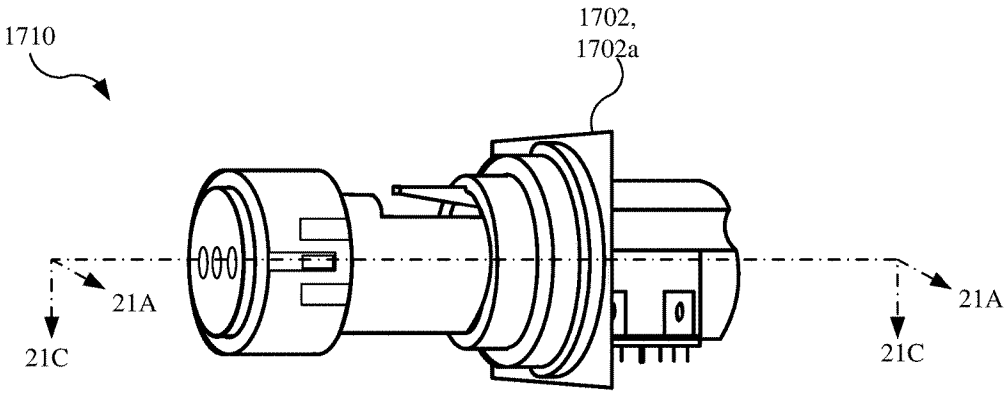
FIG. 17A is a perspective view of another connector system shown in a first state.
Figure 17B:
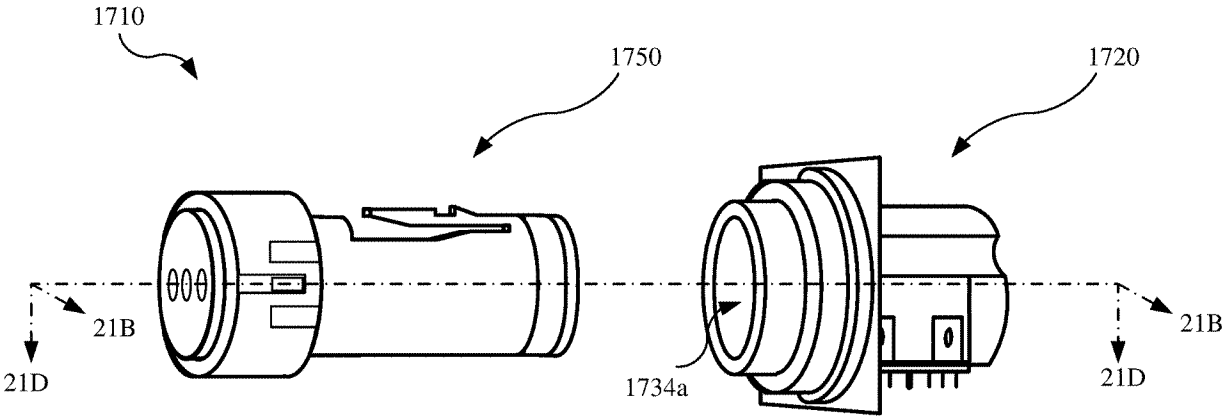
FIG. 17B is a perspective view of the connector system of FIG. 17A shown in a second state.

Referring to FIG. 2, the receptacle assembly 120 provides a combined power/data connection point 222 at which the receptacle assembly 120 receives the plug assembly 150 to provide combined power and data connections (i.e., by providing power transfer and data transfer via separate electrical connections). The receptacle assembly 120 may additionally include one or more or data-only connection points 224 at which the receptacle assembly 120 receives other connectors to provide a data-only connection (i.e., by providing data transfer via an electrical connection, which may include incidental power transfer at low levels). The connector system 110 additionally provides electromagnetic shielding to prevent interference that might otherwise occur due to the relatively high electrical output of the power connection (e.g., 48V or 60V at approximately 15 amps), close proximity of other electronic components to the connections formed between the receptacle assembly 120 and the plug assembly 150, and a high prevalence of interference sources in the vehicle 100 (e.g., electrical powertrain, etc.). The connector system 110 may additionally be configured to provide a sealed connection between the receptacle assembly 120 and the plug assembly 150, as well as within the receptacle assembly 120 itself, thereby allowing the connector system 110 to be used in locations of the vehicle 100 that are unenclosed and exposed to external environmental conditions (e.g., rain, snow, dust, etc.). According to alternative embodiments, the receptacle assembly 120 may be configured with different numbers of combined power/data connection points 222 and data-only connection points 224. For example, as shown in FIG. 16, a receptacle assembly 1620 includes four combined power/data connection points 222 and four data-only connection points 224.

Referring to FIGS. 1-4, the cable 160 is fixedly coupled to the plug assembly 150, so as to be able to transfer both power and data to the module 103. For data transfer, the cable 160 may be configured similar to a coaxial cable, as described in further detail below, but may instead be configured similar to other types of shielded data transfer cables (e.g., shielded twisted pair, etc.).

Figure 5:
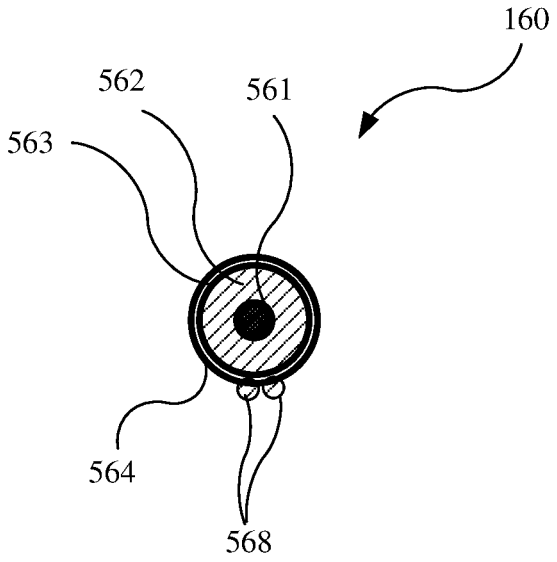
FIG. 5 is a cross-sectional view of the cable taken along line 5-5 in FIG. 4

As shown in the cross-sectional view in FIG. 5, the cable 160 includes a central data conductor 561, an insulator layer 562, and a shielding layer 563, and may additionally include a protective layer 564 (e.g., jacket or additional insulating layer). The cable 160 is also configured to transfer power, and includes appropriate power conductors 568, which may, for example, be round copper cables. The power conductors 568 may be power and ground conductors.

Figure 6:
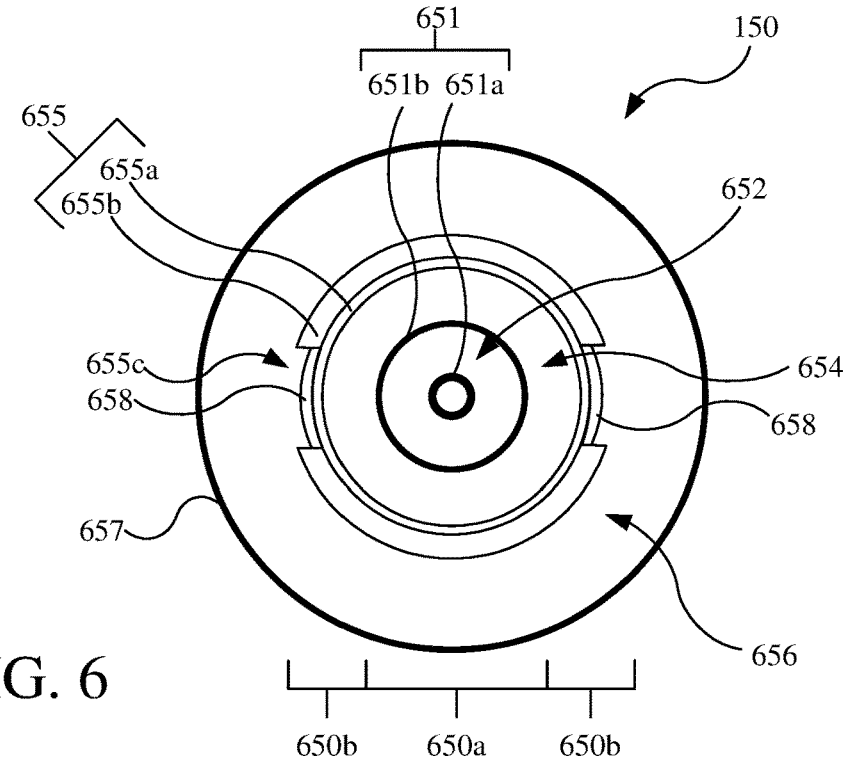
FIG. 6 is a front elevation view of the connector shown in FIG. 2.
Figure 7:
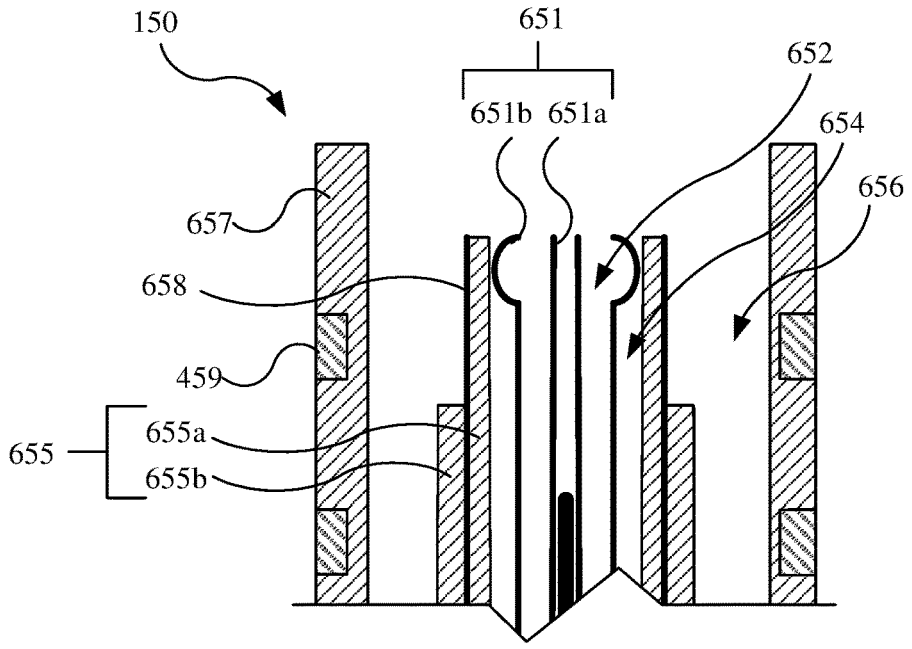
FIG. 7 is a cross-sectional view of the connector taken along line 7-7 in FIG. 4.
Figure 8A:
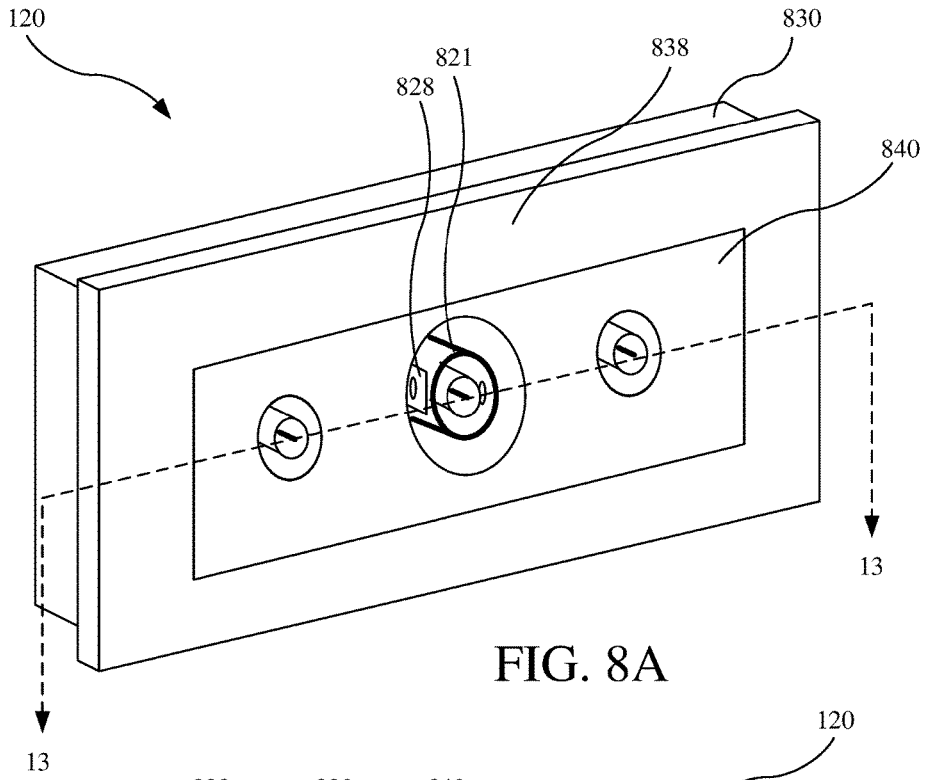
FIG. 8A is an upper, front, left perspective view of a receptacle assembly of the exemplary connector system shown in FIG. 2.
Figure 8B:
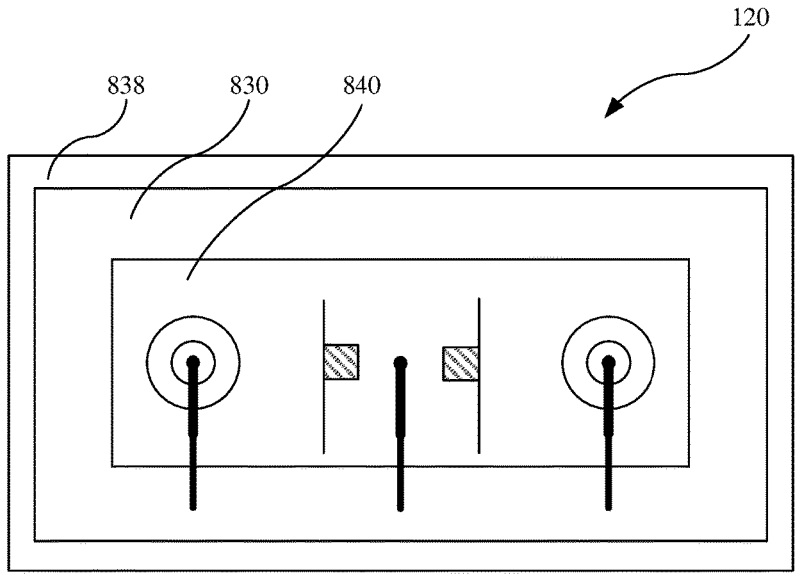
FIG. 8B is a rear elevation view of the receptacle assembly shown in FIG. 8.
Figure 14:
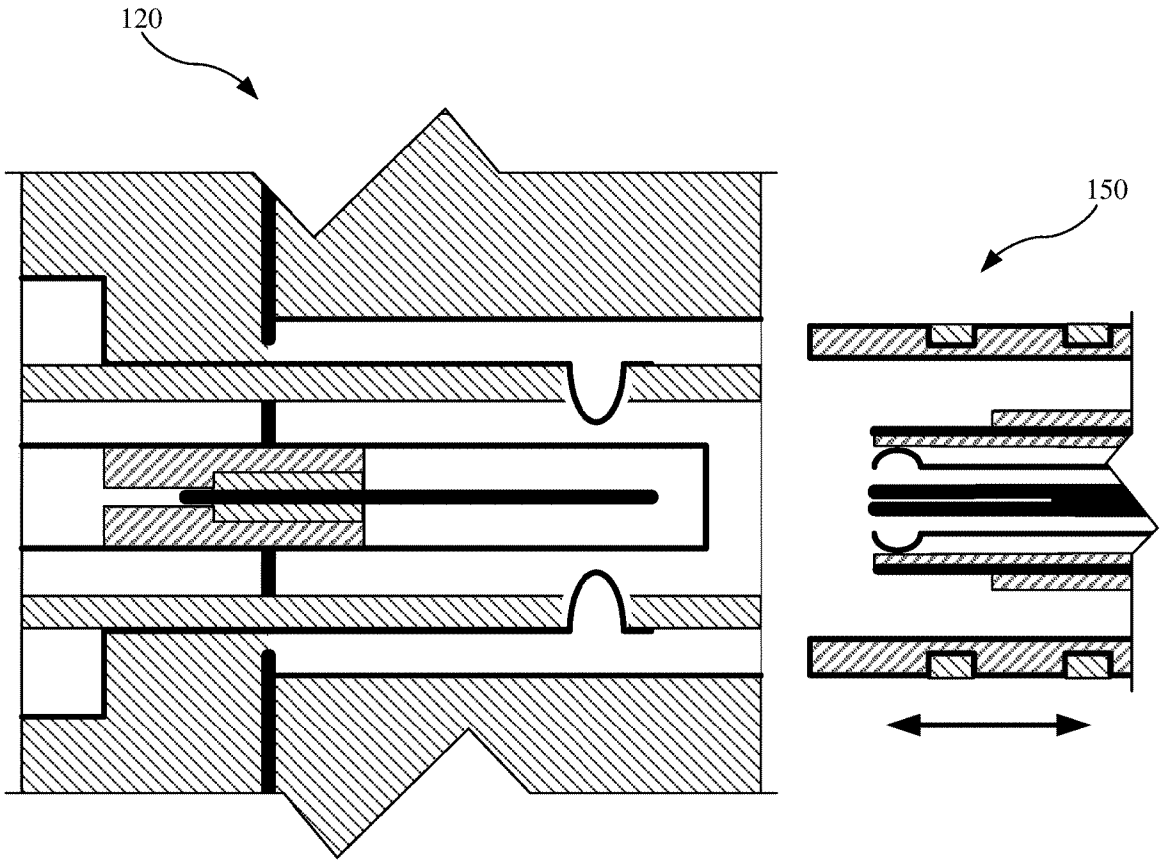
FIG. 14 is a cross-sectional view of the connector system taken along line 14-14 in FIG. 2, which depicts the plug removed from the receptacle assembly.
Figure 15:
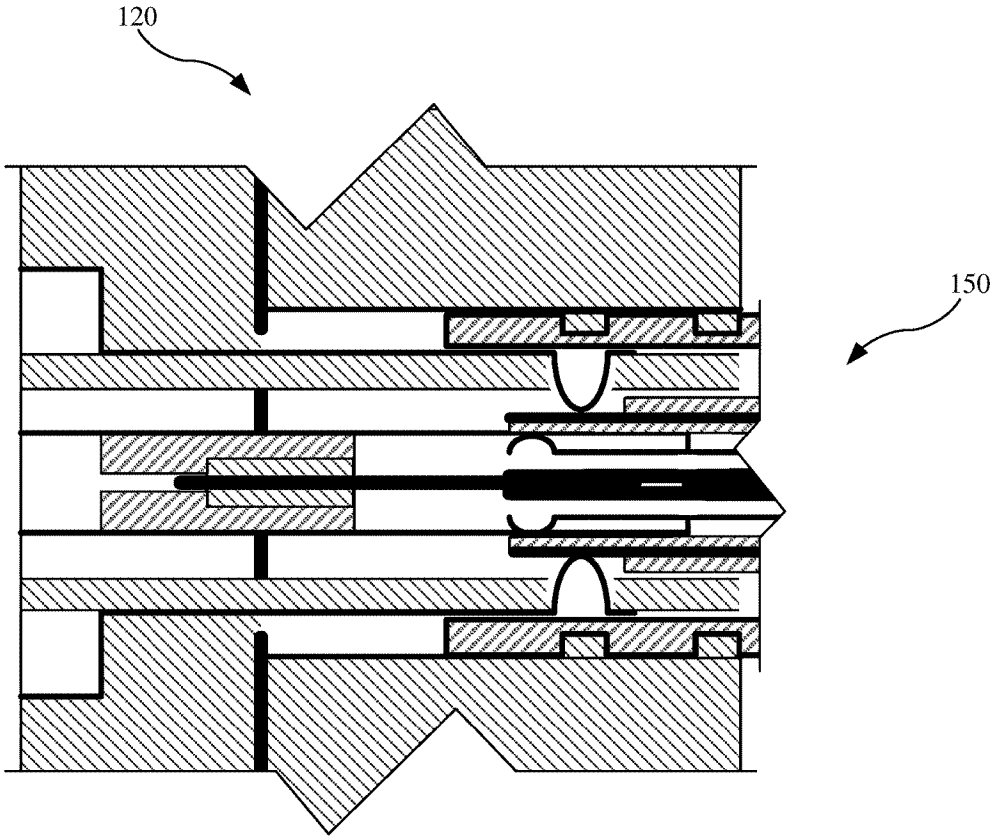
FIG. 15 is a cross-sectional view of the connector system taken along line 15-15 in FIG. 2, which depicts the plug inserted in receptacle assembly.

The plug assembly 150 is coupled to the cable 160 and is configured to be received by (e.g., mate with) the receptacle assembly 120, so as to transfer both power and data therewith. Referring to FIGS. 6-7, the plug assembly 150 includes a radially inner portion 650*a* (e.g., inner or data connector portion) for data transfer and a radially outer portion 650*b* (e.g., outer or power connector portion) for power transfer. By arranging various data transfer components radially in between the various power transfer components, efficient packaging of combined power and data transfer connector system is achieved. FIGS. 14-15 are cross-sectional views of the plug assembly 150 and the receptacle assembly 120, which illustrate the spatial relationships of the various features thereof.

The plug assembly 150 generally includes, moving radially outward, a data connector 651, an intermediate circumferential gap 654, an intermediate annular portion 655, an outer circumferential gap 656, and an outer annular portion 657. The data connector 651 is provided in the radially inner portion 650*a* of the plug assembly 150 and includes a female data terminal 651*a* and an annular member 651*b* (e.g., plug shield component), which are separated by an inner circumferential gap 652. The plug assembly 150 additionally includes at least two power terminals 658 (e.g., contacts), which are provided in the radially outer portion 650*b* of the plug assembly 150, as well as one or more annular seal members 459 (e.g., annular seal; shown in FIG. 4). The two power terminals 658 may be power and ground terminals. The power terminals 658 may also be referred to as contacts (e.g., a power contact and a ground contact). The female data terminal 651*a* may also be referred to as a data contact.

The female data terminal 651*a* and the annular member 651*b* of the data connector 651 of the plug assembly 150 are electrically coupled, respectively, to the data conductor 561 and the shielding layer 563 of the cable 160.

The female data terminal 651*a* of the data connector 651 is additionally configured to receive therein a male data pin 921*a* of data connector 821 of the receptacle assembly 120 to electrically couple therewith for data transfer. Similarly, the annular member 651*b* is configured to receive therein another annular member 921*b* of the data connector 821 to electrically couple therewith to form a continuous shield. It should be noted, however, that these male/female relationships may be reversed, such that the data connector 651 of the plug assembly 150 instead includes a male data pin and an annular member that are received within a female data terminal and an annular member of the data connector 821 of the receptacle assembly 120. The data connector 821 of the receptacle assembly 120 is discussed in further detail below. The male data pin 921*a* and the female data terminal 651*a* may each be referred to as a data terminal.

The intermediate circumferential gap 654 separates the data connector 651 from the intermediate annular member 655 and the power terminals 658, and is configured to receive therein an annular portion 930*c* of a body member 840 (e.g., molded body) of the receptacle assembly 120, which are discussed in further detail below.

The intermediate annular member 655 of the plug assembly 150 is non-conductive and includes a radially inner portion 655*a* and a radially outer portion 655*b*. The radially inner portion 655*a* has a smaller outer diameter and extends axially further than radially outer portion 655*b*. A step is, thereby, formed at the axial transition between the radially inner portion 655*a* and the radially outer portion 655*b*. The radially outer portion 655*b* of the intermediate annular member 655 additionally includes a plurality of circumferentially spaced recesses 655*c*, which correspond to and have received therein the power terminals 658.

The power terminals 658 of the plug assembly 150 are conductive members that are each electrically coupled to one of the power conductors 568 of the cable 160. Each power terminal 658 is positioned in one of the recesses 655*c* of the intermediate annular member 655. Each power terminal 658 faces radially outward to receive thereagainst a corresponding power terminal 828 (e.g., power and ground terminals) of the receptacle assembly 120 to electrically connect therewith, as discussed in further detail below.

Outer surfaces of the power terminals 658 are spaced apart a greater distance than the outer surface of the radially inner portion 655*a* and a lesser distance then the outer surface of the radially outer portion 655*b*. As such, the outer surfaces of the power terminals 658 are radially recessed relative to the outer surface of the radially outer portion 655*b* and radially proud of the outer surface of the radially inner portion 655*a*.

The outer circumferential gap 656 of the plug assembly 150 is configured to receive another outer annular portion 1340*c* and the power terminals 828 of the receptacle assembly 120 therein, as discussed in further detail below.

The outer annular portion 657 and the annular seal members 459 of the plug assembly 150 are configured to be received in and form a seal with a recess 1147 of the receptacle assembly 120, as discussed in further detail below.

The receptacle assembly 120 is configured to receive the plug assembly 150 to transfer electrical power and data therewith. The receptacle assembly 120 is additionally configured to shield electronic components (e.g., the controller 102, PCB, or other electronic components in the enclosure 104) from electromagnetic interference that might otherwise be caused by the power connection of the connector system 110 or otherwise transferred thereto. The receptacle assembly 120 and the plug assembly 150 are also configured to physically engage each other to form a mechanical connection therebetween, while also preventing intrusion of water and debris and maintain robust power and data connections in view of noise, vibration, and harshness (NVH) inputs to the connector system 110.

Referring to FIGS. 2 and 8-15, the receptacle assembly 120 generally includes a data connector 821, two or more power terminals 828, a shield structure 830 (e.g., shield) that includes or is coupled to a front plate 838 (e.g., a forward shield structure), and a body member 840 (e.g., molded component, body, or insert). The two or more power terminals 828 may also be referred to as contacts (e.g., a power contact and a ground contact).

Figure 9:
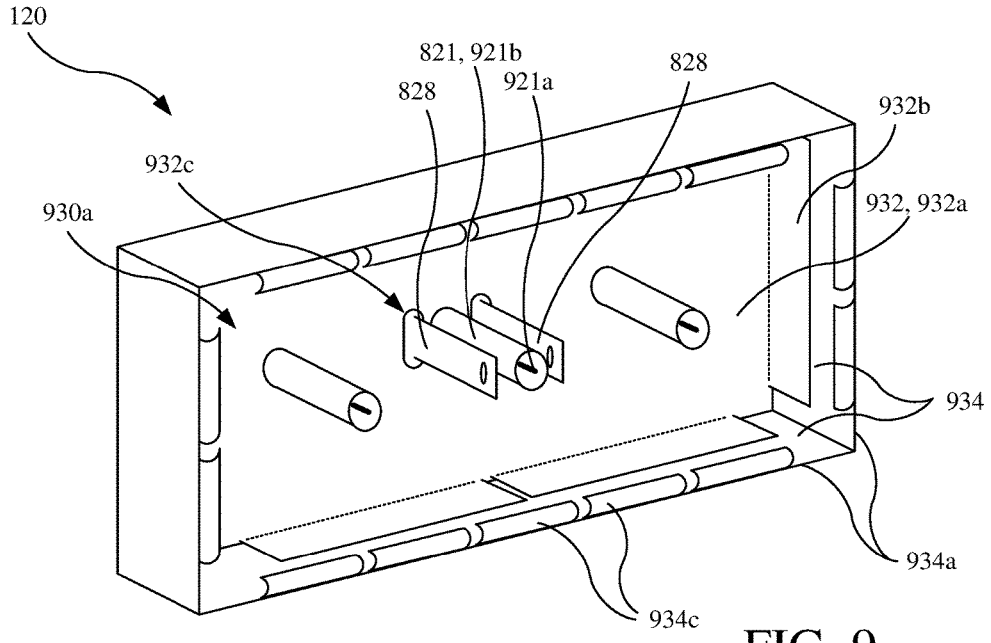
FIG. 9 is a partial upper, front, left perspective view of the receptacle assembly shown in FIG. 8.
Figure 10:
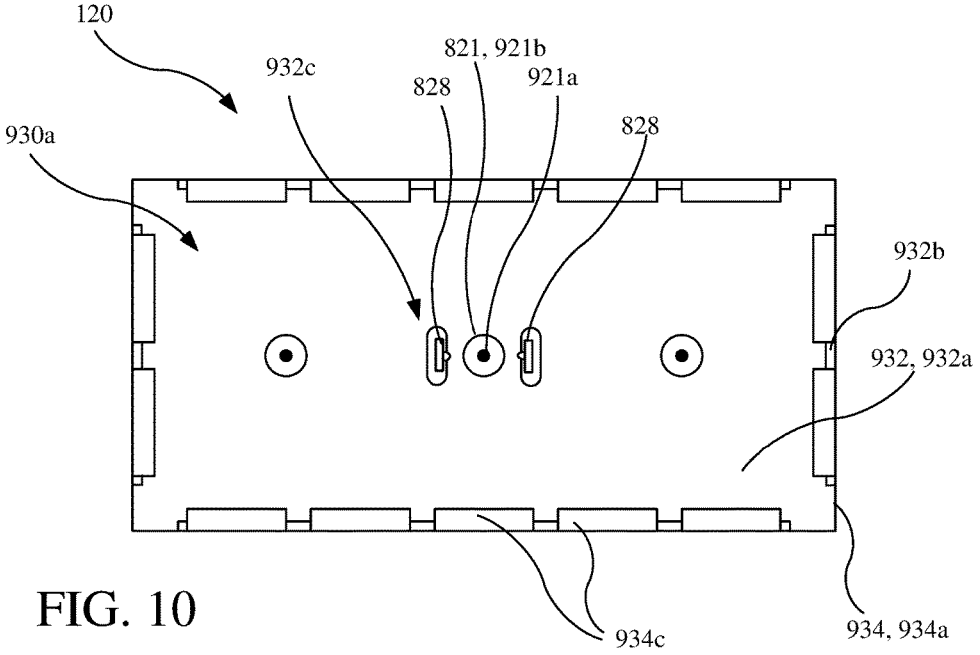
FIG. 10 is a partial front elevation view of the receptacle assembly shown in FIG. 8.

Referring to the partial views in FIGS. 9-10, the shield structure 830 of the receptacle assembly 120 is configured to prevent electromagnetic interference (e.g., electrical noise) caused by any source within the vehicle 100 or an environment of the vehicle 100 from entering the enclosure 104 and impacting the controller 102 or other electrical components (e.g., PCB) therein. For example, the cable 160 might otherwise act as an antenna and form a pathway by which the electrical noise might otherwise enter the enclosure 104. The shield structure 830 of the receptacle assembly 120 is electrically coupled to the shielding layer 563 of the cable 160 and to the enclosure 104. The shield structure 830 thereby provides a path (e.g., a shield pathway), which electrically couples (e.g., grounds) the shielding layer 563 of the cable 160 to the shield structure 830 to the enclosure 104. The shield structure 830 substantially surrounds the power connection that is formed by physical contact between the power terminals 658, 828, respectively, of the plug assembly 150 and the receptacle assembly 120 with the power connections being electrically insulated or isolated from the shield structure 830 (e.g., such that power pathways, such as power and ground pathways or paths, formed by the power connections thereby passes through the shield structure 830 without making contact therewith). The shield structure 830 also substantially surrounds the data connections formed by the physical contact between the data connectors 651, 821 of the plug assembly 150 and the receptacle assembly 120 with the data connections being electrically insulated or isolated from the shield structure 830 (e.g., such that data pathways or paths formed thereby pass through the shield structure 830 without making contact therewith).

For example, the shield structure 830 is a box structure formed of or otherwise comprising appropriate metal material used for electromagnetic shielding. The shield structure 830 defines a cavity 930*a* (e.g., recess) in which the data connector 821 and the power terminals 828 are positioned. As referenced above, and as is shown in FIG. 1, the shield structure 830 may be recessed into and/or electrically coupled to the enclosure 104.

The enclosure 104 is itself made from an electrically conductive material (e.g., metal and/or conductive polymer) and surrounds (e.g., partially, substantially, or entirely) the controller 102, PCB, or other electronic components in the enclosure 104. The enclosure 104 is configured to shield components contained therein from electromagnetic interference, and may be referred to as an electromagnetic shield enclosure. With the shield structure 830 being electrically coupled to both the shielding layer 563 of the cable 160 and the enclosure 104, the shield structure 830 forms the shield pathway, which electrically connects (e.g., grounds) the shielding layer 563 to the enclosure 104 to prevent propagation of electromagnetic interference into the enclosure 104.

In one example, the shield structure 830 is a multi-component assembly. The shield structure 830 includes a back plate 932 and a peripheral shell 934, which cooperatively form a rear shield structure and define the cavity 930*a* therein. The back plate 932 forms a rear surface 932*a* of the cavity 930*a*. The back plate 932 additionally includes apertures (e.g., apertures 932*c*) through which the data connector 821 and the power terminals 828 extend into the cavity 930*a*, so as to be substantially surrounded by the shield structure 830. The back plate 932 includes flanges 932*b* (e.g., tabs, extensions, etc.) that are bent forward from the rear surface 932*a* (e.g., at a 90 degree angle, represented by the broken lines in FIG. 9), and which are electrically and physically coupled to mating surfaces of the peripheral shell 934 (e.g., via laser welding).

The peripheral shell 934 of the shield structure 830 forms outer walls 934*a* (e.g., four to form a rectangle or square cross-section) of the shield structure 830. The outer walls 934*a* extend rearward from forward edges 934*b* (e.g., forward peripheral edge) thereof to or beyond the rear surface 932*a* of the back plate 932. The forward edges 934*b* of the peripheral shell 934 include a plurality of members 934*c* (e.g., fingers, protrusions, etc.) formed integrally therewith. The members 934*c* are bent or curved inward from the outer walls 934*a* toward the cavity 930*a*. The members 934*c* are spaced apart from each other and cooperatively form the forward edge 934*b* for receiving and forming an electrical connection with the front plate 838. Among other considerations, maximum dimensions of the gaps or voids between the members 934*c* may be determined according to the lowest wavelength (and the highest frequency) of the electromagnetic frequency expected. For example, the maximum dimension of the void between the members 934*c* may be between 1.5 and 10 mm (e.g., approximately 1.5 mm, which corresponds to electromagnetic interference having a frequency of approximately 20 GHz).

Instead of or in addition to the members 934*c*, a conductive gasket may instead be arranged (e.g., compressed) between the peripheral shell 934 and the front plate 838 to form an electrical connection therebetween and continuously around the shield structure 830.

Thus, the shield structure 830 substantially surrounds the electrical and data connections formed by the physical contact between the data connectors 651, 821 and the power terminals 658, 828 of the plug assembly 150 and the receptacle assembly 120, respectively, by extending behind (e.g., with the back plate 932), around, and forward (e.g., with the outer walls 934*a*) of such physical contact, while having a forward opening for receiving the plug assembly 150. In other embodiments, the shield structure 830 may be configured in other manners including, for example, comprising fewer or more components (e.g., one integrally formed component, or more than two components coupled together), being proud of or flush with the enclosure 104, or other suitable configurations.

Figure 11:
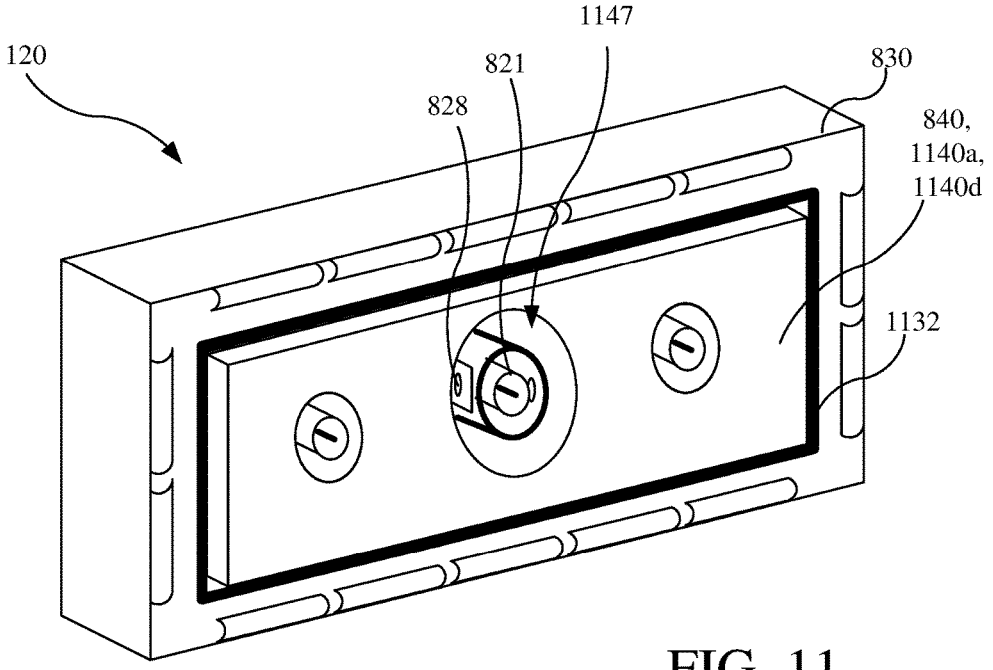
FIG. 11 is another partial upper, front, left perspective view of the receptacle assembly shown in FIG. 8.
Figure 12:
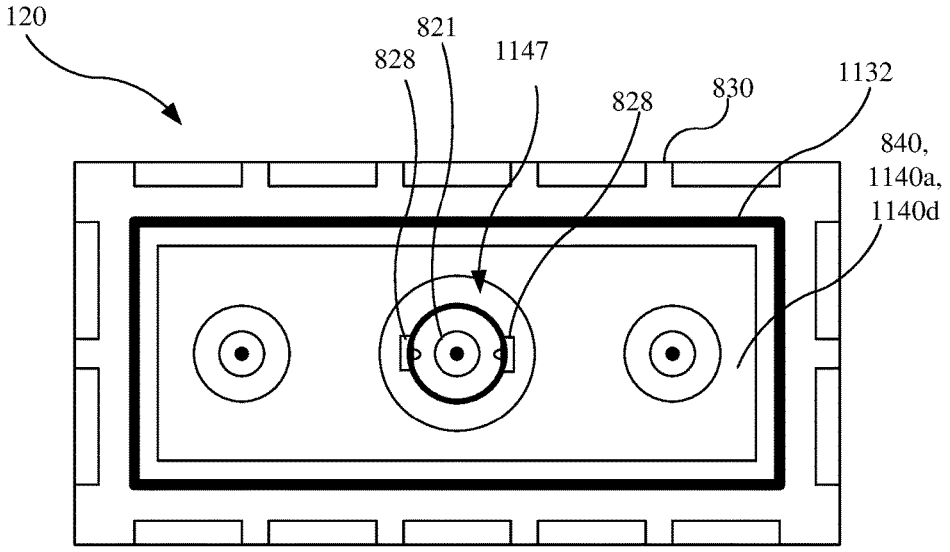
FIG. 12 is another partial front elevation view of the receptacle assembly shown in FIG. 8.
Figure 13:
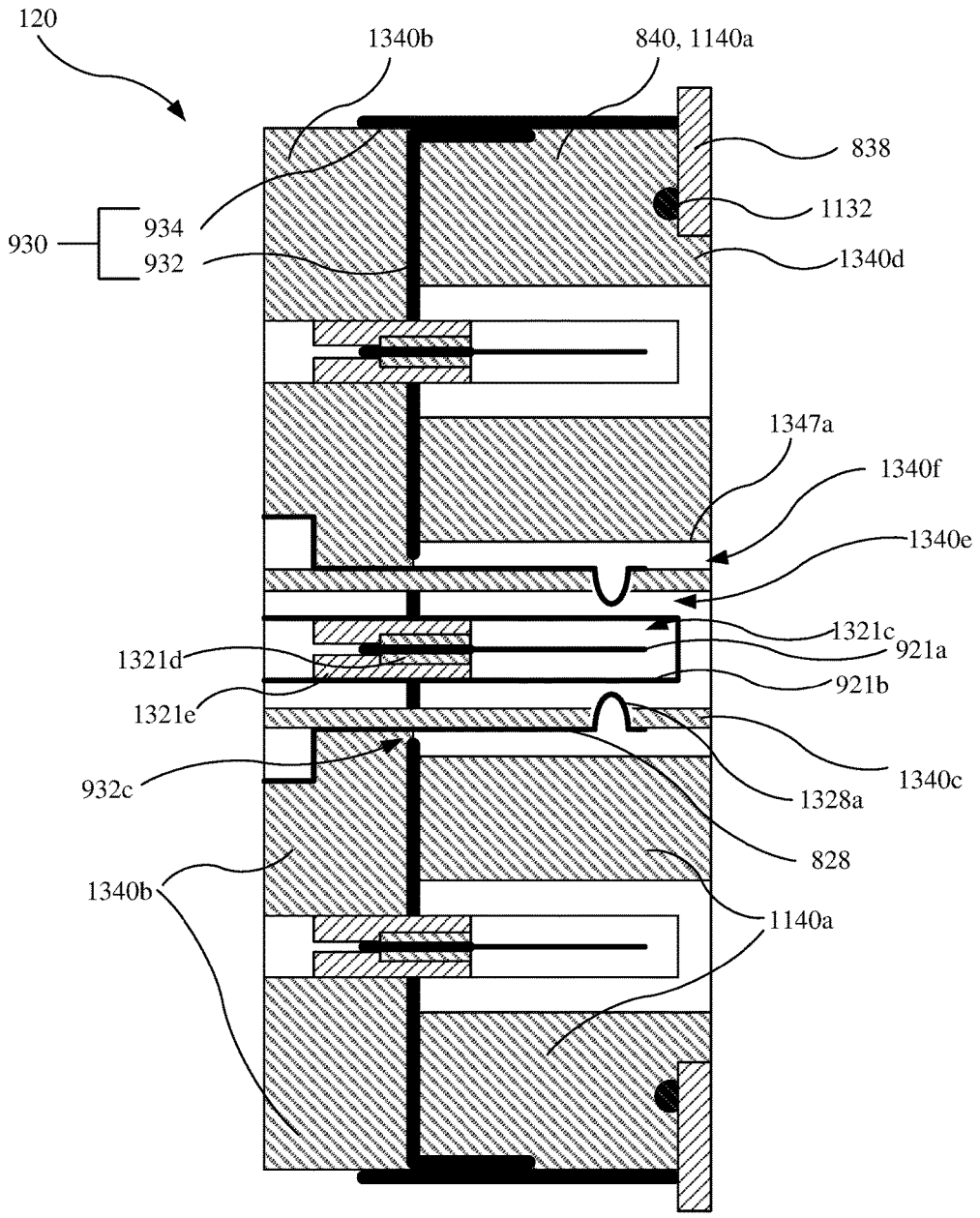
FIG. 13 is a cross-sectional view of the receptacle assembly taken along line 13-13 in FIG. 8.

Referring to the partial views in FIGS. 11-12, as well as the cross-sectional views in FIGS. 13-15, the body member 840 is configured to receive the plug assembly 150 and other connectors (e.g., data-only) to form a mechanical connection therewith, so as to facilitate and maintain electrical connections with the data connector 821 and the power terminals 828.

The body member 840 may be a polymer component that may be insert-molded with the shield structure 830, so as to be directly coupled to the shield structure 830. The body member 840 includes a forward portion 1140*a* that is positioned within the cavity 930*a* of the shield structure 830, and may also include a rearward portion 1330*b* (best seen in the cross-sectional view of FIG. 13). The rear portion 1340*b* is formed continuously with the forward portion 1140*a* or may be separated therefrom by the shield structure 830 (e.g., being a separate component), but in either instance may be formed via the insert molding process. In other embodiments, the body member 840 may be made from another type of material and and/or be made with or coupled to the shield structure 830 in other manners.

The forward portion 1140*a* of the body member 840 defines one or more recesses 1147 (e.g., recesses) configured to receive one of the plug assemblies 150 or other connectors (e.g., for data-only; not shown). Each recess 1147 includes therein the power terminals 828 and the data connector 821. Each recess 1147 is of sufficient axial depth to receive the plug assembly 150 there to make appropriate electrical contact between the data connector 821 and the power terminals 828 of the receptacle assembly 120 with the data connector 651 and the power terminals 658, respectively, of the plug assembly 150.

The forward portion 1140*a* of the body member 840 is additionally configured to seal with the front plate 838. More particularly, the forward portion 1140*a* of the body member 840 includes a protrusion 1140*d*, along with a seal member 1132 surrounding the protrusion 1140*d*. The protrusion 1140*d* is received in a complementary aperture (not labeled) in the front plate 838, and may be flush with a forward surface thereof.

The seal member 1132 engages and is compressed by a rear surface of the front plate 838 to form a seal between the body member 840 to prevent intrusion of liquids and/or debris into and/or through the receptacle assembly 120. Prior to the front plate 838 being coupled to the receptacle assembly 120, the seal member 1132 is in a relaxed, uncompressed state and is positioned forward of the members 934*c* of the peripheral shell 934 of the shield structure 830.

The front plate 838 extends laterally outward from the cavity 930*a* and may also extend laterally inward for the shield structure 830 to further surround the electrical connections (i.e., the physical contact between the data connectors 651, 821 and the power terminals 658, 828 of the plug assembly 150 and the receptacle assembly 120). The front plate 838 is electrically coupled to the shield structure 830 by contacting and/or being welded to the members 934*c* of the shield structure 830 and/or by both contacting a conductive gasket, as referenced above. The front plate 838 is additionally mechanically coupled directly or indirectly to the shield structure 830 to sufficiently compress the seal member 1132 therebetween to prevent intrusion of water and/or debris therebetween. For example, the front plate 838 may be coupled to the shield structure 830 with mechanical fasteners (e.g., screws or other elongated fasteners) or laser welding (e.g., to the members 934*c*), other features of or exterior to the shield structure 830 (e.g., tabs, or clips), or other fasteners or other features that draw the back plate 932 and the front plate 838 toward each other (e.g., fasteners extending through the body member 840). Furthermore, the front plate 838 may be part of or coupled to the enclosure 104, such that the enclosure 104 is also mechanically and/or electrically coupled to the shield structure 830.

Referring to FIGS. 11-15, the data connector 821 of the receptacle assembly 120 is positioned centrally within the recess 1147 and laterally (e.g., radially) between the power terminals 828. This arrangement of the data connector 821 between the power terminals 828 in the receptacle assembly 120 corresponds to that for the data connector 651 and the power terminals 658 of the plug assembly 150.

Referring to FIGS. 9 and 13-15, the data connector 821 extends rearward through the back plate 932 of the shield structure 830. As referenced previously, the data connector 821 generally includes a male data pin 921*a* and an annular member 921*b*. The data connector 821 may also be referred to as a data contact. The male data pin 921*a* may also be referred to as a data conductor, while the annular member may 921*b* may be referred to as a shield member.

As shown in FIG. 13, in a forward region forward of the back plate 932 of the shield structure 830, the data connector 821 includes an inner circumferential gap 1321*c* that separates the male data pin 921*a* and the annular member 921*b*.

In a rearward region behind the back plate 932, the data connector includes one or more insulators or mechanical couplings 1321*d*, 1321*e* arranged between the male data pin 921*a* and the annular member 921*b*. The male data pin 921*a* may, for example, be positioned axially rearward of a forward end of the annular member 921*b*, and extend rearward through the back plate 932 of the shield structure 830 (e.g., to be electrically coupled to the controller 102 or other electronic component). The annular member 921*b* is electrically coupled to the back plate 932 of the shield structure 830 and may also extend therethrough.

When the plug assembly 150 is inserted in the recess 1147 of the receptacle assembly 120, the male data pin 921*a* of the data connector 821 of the receptacle assembly 120 is received within and contacts the female data terminal 651*a* of the data connector 651 of the plug assembly 150 to form an electrical connection therebetween. Furthermore, the annular member 651*b* of the data connector 651 of the plug is received within and contacts the annular member 921*b* of the data connector 921 of the receptacle assembly 120 to form an electrical connection therebetween, which also electrically couples the shield structure 830 to the shielding layer 563 of the cable 160. With this electrical contact, data and shield connections are formed between the plug assembly 150 and the receptacle assembly 120.

The power terminals 828 extend through apertures 932*c* in the back plate 932. The power terminals 828 are separated from the annular member 921*b* of the data connector 821 with an intermediate circumferential gap 1340*e* and an annular portion 1340*c* of the body member 840. The annular portion 1340*c* of the body member 840 may, for example, be coupled to the rear portion 1340*b* of the body member 840 through the apertures 932*c* in the back plate 922, such as being formed therewith during the insert-molding process. The power terminals 828 each extend axially along a radially outer surface of the annular portion 1340*c*, and include a protrusion 1328*a* that protrudes radially inwardly through apertures (not labeled) of the annular portion 1340*c* toward, but not in contact with, the annular member 921*b* of the data connector 821.

When the plug assembly 150 is inserted in the recess 1147 of the receptacle assembly 120, the intermediate annular member 655 of the plug assembly 150, along with the power terminals 658, is received in the gap 1340*e*. Moreover, the protrusions 1328*a* of the power terminals 828 in the receptacle assembly 120 are received against the power terminals 658 of the plug assembly 150 to electrically couple therewith. With this electrical contact, a power connection is formed between the plug assembly 150 and the receptacle assembly 120.

The protrusions 1328*a* of the power terminals 828 of the receptacle assembly 120 may also be positioned within the recesses 655*c* of the intermediate annular member 655 of the plug assembly 150, which may function to mechanically align the plug assembly 150 with the receptacle assembly 120.

An outer circumferential gap 1340*f* is positioned radially outward from the annular portion 1340*c* of the body member 840 and the power terminals 828. When the plug assembly 150 is inserted in the recess 1147 of the receptacle assembly 120, the outer annular portion 657 of the plug assembly 150 is received within the outer circumferential gap 1340*f*.

The outer annular portion 657 of the plug assembly 150 thereby engages the body member 840 of the receptacle assembly 120 to form a mechanical and/or sealing connection therewith. More particularly, the recess 1147 has an inner periphery 1347*a* (e.g., an inner radial surface) that is complementary to the outer annular portion 657 and the annular seal members 459 of the plug assembly 150. For example, the inner periphery 1347*a* has a diameter that is slightly larger an outer diameter of the outer annular portion 657 of the plug assembly 150 and slightly smaller than an outer diameter of the annular seal members 459, thereby allowing receipt of the plug assembly 150 therein and compressing the annular seal members 459 to form a seal against the inner periphery 1347*a* of the body member 840.

Referring to FIGS. 17A-21D, another connector system 1710 is configured to transfer both electrical power and signals (e.g., control and/or data signals), for example, between the power source 101 and/or the controller 102 and the module 103 located remotely thereto (see FIG. 1). The connector system 1710 generally includes a receptacle assembly 1720 coupled to an enclosure 1702 (shown partially) and a plug assembly 1750. The enclosure 1702 is a metal enclosure (e.g., a metal box) of which only a single wall 1702*a* is shown and in which a circuit board (e.g., PCB) may be positioned. The wall 1702*a* may be a forwardmost wall of the enclosure 1702 or may be recessed relative to other portions of the enclosure 1702 and/or surrounding components (e.g., functional and/or aesthetic covers). The receptacle assembly 1720 is configured to receive the plug assembly 1750 to provide combined power and data connections, more particularly, by providing power transfer and data transfer via separate electrical connections, as well as provide a mechanical connection therebetween. The receptacle assembly 1720 may also be referred to as a receptacle, receiver, base, female assembly, or female connector. The plug assembly may also be referred to as a plug, plug connector, male assembly, or male connector.

The connector system 1710 is configured to provide electromagnetic shielding to prevent or limit interference that might otherwise occur, for example, due to relatively high electrical output of the power connections (e.g., 48V or 60V at approximately 15 amps), due to close proximity of other electronic components to the power and data connections, and/or due to a high prevalence of interference sources in the vehicle 100 (e.g., electric powertrain, etc.). The connector system 1710 is additionally configured to provide a sealed connection between the receptacle assembly 1720 and the plug assembly 1750 to prevent intrusion of external conditions (e.g., rain, snow, dust, etc.) that may be prevalent in vehicular applications.

Figure 18:
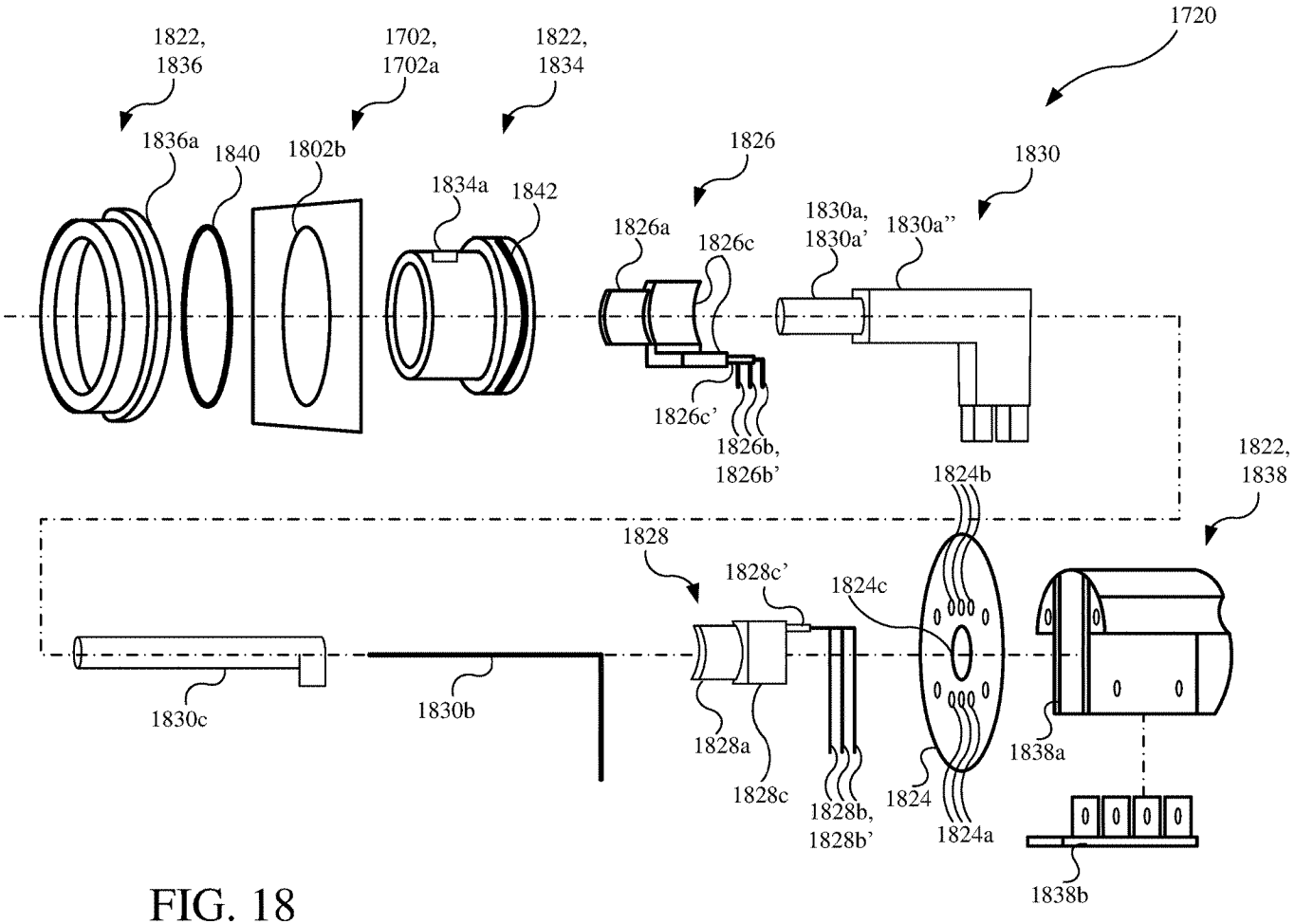
FIG. 18 is an exploded, perspective view of a receptacle assembly of the connector system of FIG. 17A.

Referring additionally to FIG. 18, the receptacle assembly 1720 generally includes a housing 1822, a shield plate 1824, a power contact 1826, a ground contact 1828, and a data contact 1830. Generally speaking, the power contact 1826 and the ground contact 1828 are configured to transfer or conduct electricity between components internal to and external from the enclosure 1702. The data contact 1830 is configured to transfer data between data components internal to and external from the enclosure 1702. The shield plate 1824 provides electromagnetic shielding. The housing 1822 is mechanically connected to each of the power contact 1826, the ground contact 1828, and the data contact 1830 and to the enclosure 1702, and is further configured to removably receive the plug assembly 1750. The power contact 1826, the ground contact 1828, and the data contact 1830 may also be referred to as terminals.

When referring to various features (e.g., the receptacle assembly 1720, the plug assembly 1750, the power contact 1826, the ground contact 1828, and the data contact 1830), such features and various aspects thereof (e.g., components, features, portions, etc.) thereof may be identified using terms associated therewith (e.g., receptacle, plug, power, ground, or data), numerically (e.g., first, second, third, etc.), and/or in the alternative (e.g., another), so as to distinguish from other features and aspects of the connector system 1710. For example, a "contact portion" of the power contact 1826 may be referred to or identified as a "power contact portion," so as to distinguish from a "contact portion" of the ground contact 1828 referred to or identified as a "ground contact portion." The ground contact 1828 may also be referred to as a contact, while the power contact may be referred to as another power contact 1826. The power contact 1826, the ground contact 1828, and the data contact 1830 may also be referred to as a first contact, a second contact, and a third contact, while contact portions thereof may be referred to as a first contact portion, a second contact portion, and a third contact portion, respectively.

Referring first to the power contact 1826, the power contact generally includes a contact portion 1826*a*, a conductor portion 1826*b*, and a coupling portion 1826*c*. The contact portion 1826*a* is configured to physically contact and, thereby, electrically connect to a corresponding portion of the plug assembly 1750 as discussed in further detail below. As shown, the contact portion 1826*a* may have a curved cross-section extending in an axially forward direction away from the enclosure 1702, for example, forming a partially cylindrical surface. The power contact 1826 may also be referred to as a contact, contact assembly, or contact structure. The contact portion 1826*a* may also be referred to as a contact segment.

The conductor portion 1826*b* extends from the contact portion 1826*a* into the enclosure 1702, for example, to connect to a circuit board (not shown) arranged therein. As shown, the conductor portion 1826*b* may extend transversely from a lower end the contact portion 1826*a* (e.g., cooperatively forming an L-shape in cross-section), as well as axially rearward thereof. The conductor portion 1826*b* of the power contact 1826 includes multiple conductor segments 1826*b*' (e.g., three as shown), which are cooperatively configured (e.g., sized) to satisfy power transfer requirements (e.g., 48V or 60V at 15 amps, as referenced above). Each of the conductor segments 1826*b*' (e.g., three as shown) may extend axially rearward into the enclosure 1702, and bend transversely (e.g., downward and/or forming an L-shape) for receipt in corresponding connectors of the circuit board. For example, as shown, the conductor segments 1826*b*' may extend axially in parallel axes in a first plane, and bend to extend vertically downward in parallel axes in a second plane perpendicular to the first plane. Those portions of the conductor segments 1826*b*' extending axially may be referred to as axial portions, while those portions extending transversely may be referred to as transverse portions. The conductor segments 1826*b*' may extend a common distance to terminate at a common elevation. As a result, the conductor segments 1826*b*' of the power contact 1826 may be received in corresponding connectors (e.g., receptacles) of a circuit board that may be arranged horizontally (e.g., parallel with the axis of the receptacle assembly 1720) in the enclosure 1702. In other embodiments, the conductor portion 1826*b* and the conductor segments 1826*b*' may be configured in other manners, for example, by being provided in different numbers (e.g., less than or more than three). Still further, the conductor segments 1826*b*' may extend only in an axial direction (e.g., without being bent), so as to be received in corresponding connectors (e.g., receptacles) of a vertical circuit board (e.g., perpendicular to the axis of the receptacle assembly 1720) in the enclosure 1702.

Each of the contact portion 1826*a* and the conductor portion 1826*b*, including the conductor segments 1826*b*', are formed of a suitable electrically conductive material, such as a copper alloy. The contact portion 1826*a* and the conductor portion 1826*b* may be a singular member, for example, being formed via a stamping operation. The contact portion 1826*a* and the conductor portion 1826*b* may, collectively, be referred to as a conductive member or structure of the power contact 1826.

The coupling portion 1826*c* of the power contact 1826 is configured to mechanically connect to the housing 1822. The coupling portion 1826*c* is received in a corresponding recess or aperture of the housing 1822 (e.g., L-shaped in cross-section and discussed in further detail below), of the housing 1822 to be mechanically connected thereto (e.g., via a press-fit, adhered, or other form of mechanical connection or combinations thereof).

The coupling portion 1826*c* may also be configured to insulate the conductor portion 1826*b* of the power contact 1826 from the shield plate 1824. For example, the coupling portion 1826*c* may include cylindrical portions 1826*c*' (e.g., sheaths or sheath portions) that are each associated with one of the conductor segments 1826*b*' that extends therethrough. The cylindrical portions 1826*c*', along with the conductor segments 1826*b*', extend through apertures (discussed below). of the shield plate 1824 and prevent physical and, thereby, conductive contact between the conductor segments 1826*b*' and the shield plate 1824.

The coupling portion 1826*c* is, for example, a polymer material (e.g., nylon) that is overmolded to an intermediate region (hidden by the coupling portion 1826*c*) of the conductive member that forms the contact portion 1826*a* and the conductor portion 1826*b*. The coupling portion 1826*c* may also be referred to as a plastic, overmolded, or insulative portion or structure. The power contact 1826 may also be referred to as an overmolded contact structure.

The ground contact 1828 is configured similarly to the power contact 1826, for example, by generally including a contact portion 1828*a*, a conductor portion 1828*b*, and a coupling portion 1828*c*. Referring additionally to FIGS. 21A-21D, as arranged in the receptacle assembly 1720, the contact portion 1828*a*, the conductor portion 1828*b*, and the coupling portion 1828*c* of the ground contact 1828 are generally radially opposite the contact portion 1826*a*, the conductor portion 1826*b*, and the coupling portion 1826*c*, respectively, of the power contact 1826 relative to an axis of the receptacle assembly 1720. For example, the contact portion 1828*a* of the ground contact 1828 may be positioned horizontally across from the contact portion 1826*a* of the power contact 1826, for example, forming an opposite portion of a cylindrical surface. The ground contact 1828 may also be referred to as a contact, contact assembly, or contact structure. The contact portion 1828*a* may also be referred to as a contact segment.

A forward region of the conductor portion 1828*b* of the ground contact may be positioned vertically across from the conductor portion 1826*b* of the power contact 1826. The conductor portion 1828*b* includes multiple conductor segments 1828*b*', which extend axially further rearward than the conductor portion 1826*b* of the power contact 1826. The conductor segments 1828*b*' (e.g., three as shown), then bend transversely (e.g., downward and/or forming an L-shape) for receipt in corresponding connectors of the circuit board. For example, as shown, the conductor segments 1828*b*' may extend axially in parallel axes in a third plane (e.g., parallel with the first plane associated with the axial portions of the conductor segments 1826*b*'), and bend to extend vertically downward in parallel axes in a second plane perpendicular to the third plane (e.g., parallel with the second plane associated with the transverse portions of the conductor segments 1826*b*'). Those portions of the conductor segments 1828*b*' extending axially may be referred to as axial portions, while those portions extending transversely may be referred to as transverse portions. As shown, the transverse portions of the conductor segments 1828*b*' may be laterally offset from the transverse portions of the conductor segments 1826*b*' of the power contact 1826. In other embodiments, the conductor portion 1828*b* and the conductor segments 1828*b*' may be configured in other manners, for example, by being provided in different numbers (e.g., less than or more than three). The power contact 1826 and the ground contact 1828 may be arranged in alternative manners relative to each other, for example, with the conductor segments 1826*b*' of the power contact 1826 may instead extend further rearward than the conductor segments 1828*b*' of the ground contact 1828. The ground conductor segments 1828*b*' may also extend axially (without bending) for receipt in a vertical circuit board as referenced above.

For further details of the ground contact 1828, including the contact portion 1828*a*, the conductor portion 1828*b*, and the coupling portion 1828*c* of the ground contact 1828, refer to generally to the discussion of the power contact 1826 above, including discussion of the contact portion 1826*a*, the conductor portion 1826*b*, and the coupling portion 1826*c*, respectively.

The data contact 1830 generally includes a shield member 1830*a*, conductor 1830*b*, and a dielectric 1830*c*. The data contact 1830 extends axially forward away from the enclosure 1702 to connect with corresponding portions of the plug assembly 1750 (i.e., corresponding shield and data portions), extends axially rearward into the enclosure 1702, and bends transversely for connection to the circuit board (e.g., being L-shaped). More particularly, as arranged in the receptacle assembly 1720, the data contact 1830 is positioned between (e.g., is surrounded by) the power contact 1826 and the ground contact 1828 (e.g., in axially forward regions outside the enclosure 1702, and in axially rearward regions inside the enclosure 1702).

The shield member 1830*a* is a substantially tubular member or structure through which the conductor 1830*b* and the dielectric 1830*c* extend. A forward portion 1830*a*' of the shield member 1830*a* extends through a corresponding aperture (discussed further below) of the shield plate 1824. The forward portion 1830*a*' may also physically contact and, thereby, electrically couple the shield member 1830*a* to the shield plate 1824. A rearward portion 1830*a*" of the shield member 1830*a* may have a larger cross-section than the forward portion 1830*a*' and the aperture of the shield plate 1824, such that the rearward portion 1830*a*" physically contacts (e.g., axially abuts) and, thereby, electrically couples the shield member 1830*a* to the shield plate 1824. The rearward portion 1830*a*" extends axially from the forward portion 1830*a*' and additionally bends transversely thereto to connect to the circuit board in the enclosure 1702 (e.g., forming an L-shape). The shield member 1830*a* may, for example, be formed of a conductive metal material, such as stainless steel or material plated with stainless steel.

The conductor 1830*b* extends through the shield member 1830*a* and is electrically isolated or insulated therefrom, for example, by way of the dielectric 1830*c* or an air gap in various regions. The conductor 1830*b* extends axially forward from the enclosure 1702, axially rearward into the enclosure 1702, and bends transversely downward toward the circuit board (e.g., forming an L-shape). As arranged in the receptacle assembly 1720, the conductor 1830*b* extends parallel with and between the conductor segments 1826*b*' of the power contact 1826 and the conductor segments 1828*b*' of the ground contact 1828 and may terminate at a common distance (e.g., elevation) therewith for connection to the circuit board. For example, an axial portion of the conductor 1830*b* extends parallel with the axial portions of the conductor segments 1826*b*' and between the conductor segments 1828*b*', and a transverse portion of the conductor 1830*b* extends parallel with and between the transverse portions of the conductor segments 182*b*' and the conductor segments 1828*b*'.

The conductor 1830*b* may, for example, be made of copper alloy (e.g., brass). The conductor 1830*b* may also be referred to as a pin.

The shield plate 1824 allows the conductor segments 1826*b*' of the power contact 1826, the conductor segments 1828*b*' of the ground contact 1828, and the data contact 1830 to extend therethrough, while also providing electromagnetic shielding to prevent electromagnetic interference that might otherwise impact data signals. More particularly, the shield plate 1824 provides electromagnetic shielding across an aperture 1802*b* (e.g., enclosure aperture) of a wall 1702*a* of the enclosure 1702 through which the receptacle assembly 1720 extends. The shield plate 1824 is electrically coupled to the enclosure 1702 with the shield plate 1824 physically contacting the wall 1702*a*. For example, a surface of the shield plate 1824 faces and abuts the wall 1702*a* of the enclosure 1702 surrounding the aperture 1802*b*.

As referenced above, the shield plate 1824 includes apertures through which the conductor segments 1826*b*' of the power contact 1826, the conductor segments 1828*b*' of the ground contact 1828, and the data contact 1830 extend. More particularly, to provide high levels of electromagnetic shielding for high speed data transfer simultaneous with high power transfer (e.g., high current), multiple power apertures 1824*a* (i.e., for power conductor segments to pass therethrough) and multiple ground apertures 1824*b* (i.e., for ground conductor segments to pass therethrough) are provided.

The size of and spacing between the power apertures 1824*a* and the ground apertures 1824*b* may be configured to optimize or otherwise improve electromagnetic shielding. Among other considerations, the maximum size (e.g., diameter or other dimension) of the power apertures 1824*a* and the 1824*b* may be determined according to the lowest wavelength (and conversely the highest frequency) of the electromagnetic frequency expected. For example, the maximum dimension of the power apertures 1824*a* and the ground apertures 1824*b* may be between 1.5 and 10 mm (e.g., approximately 1.5 mm, which corresponds to electromagnetic interference having a frequency of approximately 20 GHz). For example, the power apertures 1824*a* and/or the ground apertures 1824*b* may have a diameter of up to 1.5 mm (e.g., having a 1.5 mm diameter). The power apertures 1824*a* are spaced apart laterally from each other, as are the ground apertures 1824*b* are spaced apart laterally from each other As compared to power transfer and shielding by singular, larger power and ground conductors extending through singular, larger apertures through a shield structure, similar power transfer with improved shielding may be provided by multiple, smaller ones of the power conductor segments 1826*b*' and ground conductor segments 1828*b*' extending through corresponding, smaller ones of the power apertures 1824*a* and the ground apertures 1824*b*. The shield plate 1824 also includes a data aperture 1824*c*, which is central to the shield plate 1824, such as being generally concentric with the shield plate 1824. The data aperture 1824*c* may also be arranged between (e.g., radially between) a first group of the power apertures 1824*a* and second group of the ground apertures 1824*b*. The power apertures 1824*a* in the first group may be arranged in a straight line across the shield plate 1824 (i.e., such that the straight line passes through axes of the power apertures 1824*a*). The ground apertures 1824*b* in the second group may be arranged in another straight line across the shield plate 1824 (e.g., in such that the other straight line passes through axes of the ground apertures 1824*b* and may be parallel with the line). Alternatively, the power apertures 1824*a* and/or the ground apertures 1824*b* may be arranged in arcs, such as being concentric with an axis of the data aperture 1824*c*.

The shield plate 1824 may, for example, be a stamped component formed of stainless steel. The shield plate 1824 may also be referred to as a shield, shield member, or shield structure.

As referenced above, the housing 1822 is configured to mechanically connect to the power contact 1826, the ground contact 1828, and the data contact 1830. The housing 1822 is additionally configured to mechanically and sealingly connect to the enclosure, as well as receive and removably retain the plug assembly 1750.

The housing 1822 generally includes a primary housing structure 1834, an external housing structure 1836, and an internal housing structure 1838.

The primary housing structure 1834 is positioned within the aperture 1802*b* of the wall 1702*a* of the enclosure 1702, and protrudes from the enclosure 1702. The primary housing structure 1834 may be generally tubular, for example, being generally circular in cross-sectional shape (e.g., annular) or having other cross-sectional shapes at one or more axial locations. The primary housing structure 1834 may, for example, be a unitary member made of a polymer material (e.g., polyamide), for example, via an injection molding process. The primary housing structure 1834 may, alternatively, be a multi-piece component, be made of another material, and/or be made from another manufacturing process. The primary housing structure 1834 may also be referred to as a primary or housing member or structure.

To mechanically connect to the plug assembly 1750, the primary housing structure 1834 defines a primary recess 1734*a* for selectively receiving the plug assembly 1750 therein. The primary recess 1734*a* faces away from the enclosure 1702, for example, in a forward direction. The primary housing structure 1834 may additionally include a locking feature 1834*a*, such as an aperture or recess, to receive a corresponding locking feature of the plug assembly 1750 (as discussed in further detail below).

The power contact 1826, the ground contact 1828, and the data contact 1830 are additionally mechanically connected to the primary housing structure 1834 and held stationary thereto, for example, to prevent movement relative to the shield 1824. Thereby, the contact portion 1826*a* of the power contact 1826, the contact portion 1828*a* of the ground contact 1828, and forward portions (e.g., contact portions) of the shield member 1830*a* and conductor 1830*b* of the data contact 1830 are stably arranged in the primary recess 1734*a* of the primary housing structure 1834.

More particularly, referring to FIGS. 19A-19F, the primary housing structure 1834 includes various apertures or recesses that face toward the enclosure 1702 (e.g., in a rearward direction) and in which are received the power contact 1826, the ground contact 1828, and the data contact 1830. The primary housing structure 1834 includes a power recess 1934*b*, a ground recess 1934*c*, and a data recess 1934*d*. The power recess 1934*b* is substantially L-shaped in cross-section, so as to receive therein and couple to the coupling portion 1826*c* of the power contact 1826. The power recess 1934*b* extends to the primary recess 1734*a* of the primary housing structure 1834, such that the contact portion 1826*a* of the power contact 1826 is arranged therein. The power recess 1934*b* also faces an interior of the enclosure 1702, such that the conductor portion 1826*b* (i.e., the conductor segments 1826*b*') of the power contact 1826 is arranged in the enclosure 1702. Thus, the power contact 1826 extends from the primary recess 1734*a* of the primary housing structure 1834 through the power recess 1934*b* into the enclosure 1702.

Similarly, the ground recess 1934*c* is L-shaped in cross-section, so as to receive therein and couple to the coupling portion 1828*c* of the ground contact 1828. The ground recess 1934*c* extends to the primary recess 1734*a* of the primary housing structure 1834, such that the contact portion 1828*a* of the ground contact 1828 is arranged therein. The ground recess 1934*c* also faces the interior of the enclosure 1702, such that the conductor portion 1828*b* (i.e., the conductor segments 1828*b*') of the ground contact 1828 is arranged in the enclosure 1702. Thus, the ground contact 1828 extends from the primary recess 1734*a* of the primary housing structure 1834 through the ground recess 1934*c* into the enclosure 1702.

The data recess 1934*d* is substantially circular in cross-section, so as to receive therein and couple to the data contact. The data recess 1934*d* is generally surrounded by the power recess 1934*b* and the ground recess 1934*c*. The data recess 1934*d* extends to the primary recess 1734*a* of the primary housing structure 1834, such that the contact portions of the data contact 1830 are arranged therein. The data recess 1934*d* also faces the interior of the enclosure 1702, such that the data contact 1830 extends into the enclosure 1702. Thus, data contact 1830 extends from the primary recess 1734*a* of the primary housing structure 1834 through the data recess 1934*d* into the enclosure 1702.

The external housing structure 1836 is configured to mechanically connect and seal the receptacle assembly 1720 to the enclosure 1702. The external housing structure 1836 is a generally annular structure or member. More particularly, the external housing structure 1836 is configured as a nut, which is threadably received by the primary housing structure 1834 (see threads in FIGS. 21A-21D). When tightened thereon, the external housing structure 1836 compresses the wall 1702*a* of the enclosure 1702 between the external housing structure 1836 and the shield plate 1824. Furthermore, the external housing structure 1836 may include or otherwise engage compressible seal members. For example, the external housing structure 1836 may compress in an axial direction a gasket 1840 (e.g., elastomeric O-ring) between a peripheral portion 1836*a* (e.g., configured as a radial flange) and a surface of the wall 1702*a* of the enclosure 1702. The gasket 1840 may be arranged in an axially facing groove of the peripheral portion 1836*a*, such that the peripheral portion 1836*a* may engage the wall 1702*a* and appropriately compress the gasket 1840 thereagainst. Another gasket 1842 may be arranged and compressed radially between the primary housing structure 1834 and the external housing structure 1836. The gasket 1840 and the gasket 1842, thereby, cooperatively, seal the receptacle assembly 1720 to the enclosure 1702. The external housing structure 1836 is, for example, an injection molded polymer component (e.g., polyamide). The external housing structure 1836 may also be referred to as a nut or a housing coupling member or structure.

The internal housing structure 1838 is arranged within the enclosure 1702 and, for example, prevents contact between the conductor segments 1826*b*', the conductor segments 1828*b*', and the data contact 1830, themselves, and prevents inadvertent electrical contact with other electrical components (e.g., of the circuit board). The internal housing structure may, as shown, include a first cover member 1838*a* and a bottom cap 1838*b*, each of which may be an injection molded polyamide component.

Figure 19C:
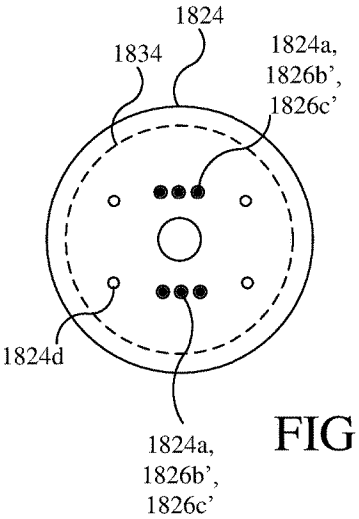
FIG. 19C is a rear view of the receptacle assembly of FIG. 18 shown in a third state of assembly.
Figure 19B:
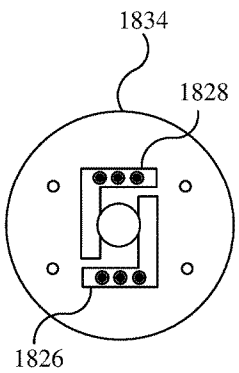
FIG. 19B is a rear view of the receptacle assembly of FIG. 18 shown in a second state of assembly.
Figure 19A:
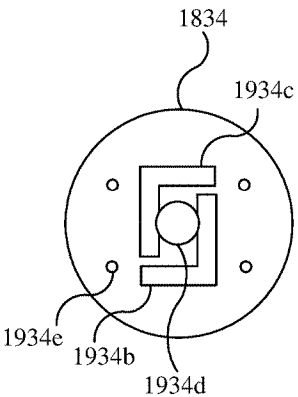
FIG. 19A is a rear view of the receptacle assembly of FIG. 18 shown in a first state of assembly.

With further reference to FIGS. 19A-19F, an assembly sequence of the receptacle assembly 1720 is described. As shown in FIG. 19A, the primary housing structure 1834 is provided.

As shown in FIG. 19B, the power contact 1826 and the ground contact 1828 are inserted into the power recess 1934*b* and the ground recess 1934*c*, respectively. During insertion, the conductor segments 1826*b*' of the power contact 1826 and the conductor segments 1828*b*' of the ground contact 1828 remain straight (e.g., extending rearward parallel with an axis of the primary housing structure 1834).

As shown in FIG. 19C, the conductor segments 1826*b*' and the cylindrical portions 1826*c*' of the power contact 1826 and the conductor segments 1828*b*' and the cylindrical portions 1828*c*' of the ground contact 1828 are inserted into the power apertures 1824*a* and the ground apertures 1824*b*, respectively, of the shield plate 1824. The shield plate 1824 is also moved axially toward the primary housing structure 1834 and abuts a rear end thereof. It should be noted that the shield plate 1824 is larger (e.g., has a larger diameter) than the primary housing structure 1834, such that edges of the shield plate 1824 extend radially outward past edges of the primary housing structure 1834 to abut forward against in internal surface of the wall 1702*a* of the enclosure 1702 surrounding the aperture 1802*b*.

Figure 19F:
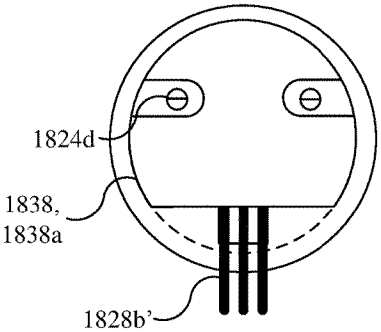
FIG. 19F is a rear view of the receptacle assembly of FIG. 18 shown in a sixth state of assembly.
Figure 19E:
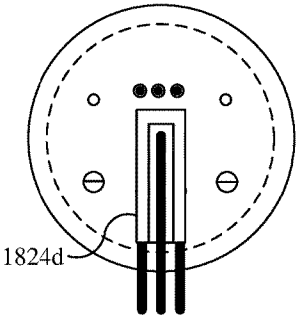
FIG. 19E is a rear view of the receptacle assembly of FIG. 18 shown in a fifth state of assembly.
Figure 19D:
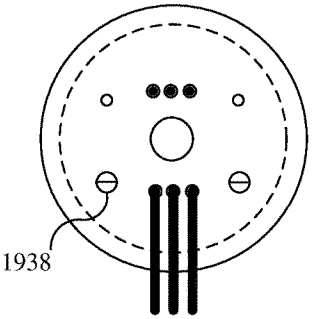
FIG. 19D is a rear view of the receptacle assembly of FIG. 18 shown in a fourth state of assembly.

As shown in FIG. 19D, the conductor segments 1826*b*' of the power contact 1826 are then bent transverse to the axis of the primary housing structure 1834. Threaded fasteners 1938 are threaded through screw apertures 1824*d* of the shield plate 1824 and into threaded bores 1934*e* of the primary housing structure 1834 to mechanically couple the shield plate 1824 to the primary housing structure 1834.

As shown in FIG. 19E, the data contact 1830 is inserted through the data aperture 1824*c*, such that the rearward portion 1830*a*" of the data contact 1830 abuts the shield plate 1824.

As shown in FIG. 19F, the conductor segments 1828*b*' of the ground contact 1828 are bent transversely downward (e.g., to be parallel with and terminate at a common height with the conductor segments 1826*b*' of the power contact 1826). The internal housing structure 1838 is then connected to the primary housing structure 1834 with other threaded fasteners 1938 that extend through the screw apertures 1824*d* of the shield plate 1824 and into threaded bores 1934*e* of the primary housing structure 1834. The primary housing structure 1834 may press the data contact 1830 axially against the shield plate 1824.

With further references to FIGS. 21A-21D, the receptacle assembly 1720 is then connected to the enclosure 1702. More particularly, the primary housing structure 1834 is inserted through the apertures 1802*b* in the wall 1702*a* of the enclosure 1702 until the shield plate 1824 engages the wall 1702*a*. More particularly, a rearmost portion of the primary housing structure 1834 may remain in the aperture 1802*b* of the enclosure 1702, while the shield plate 1824 extends radially outward thereof (as noted above) and is abutted axially against an interior surface of the wall 1702*a*.

The external housing structure 1836 is then threaded to the primary housing structure 1834. The external housing structure 1836 is further tightened, so as to press the shield plate 1824 against the wall 1702*a* and to compress the gasket 1840 between the external housing structure 1836 and an external surface of the wall 1702*a*. It should be noted that the shield plate 1824 may, rather than have a planar surface that engages the enclosure 1702, include various protrusions, clips, or other features to ensure constant (e.g., regular or repeating) contact with the enclosure 1702 around the aperture 1802*b*.

Figure 20:
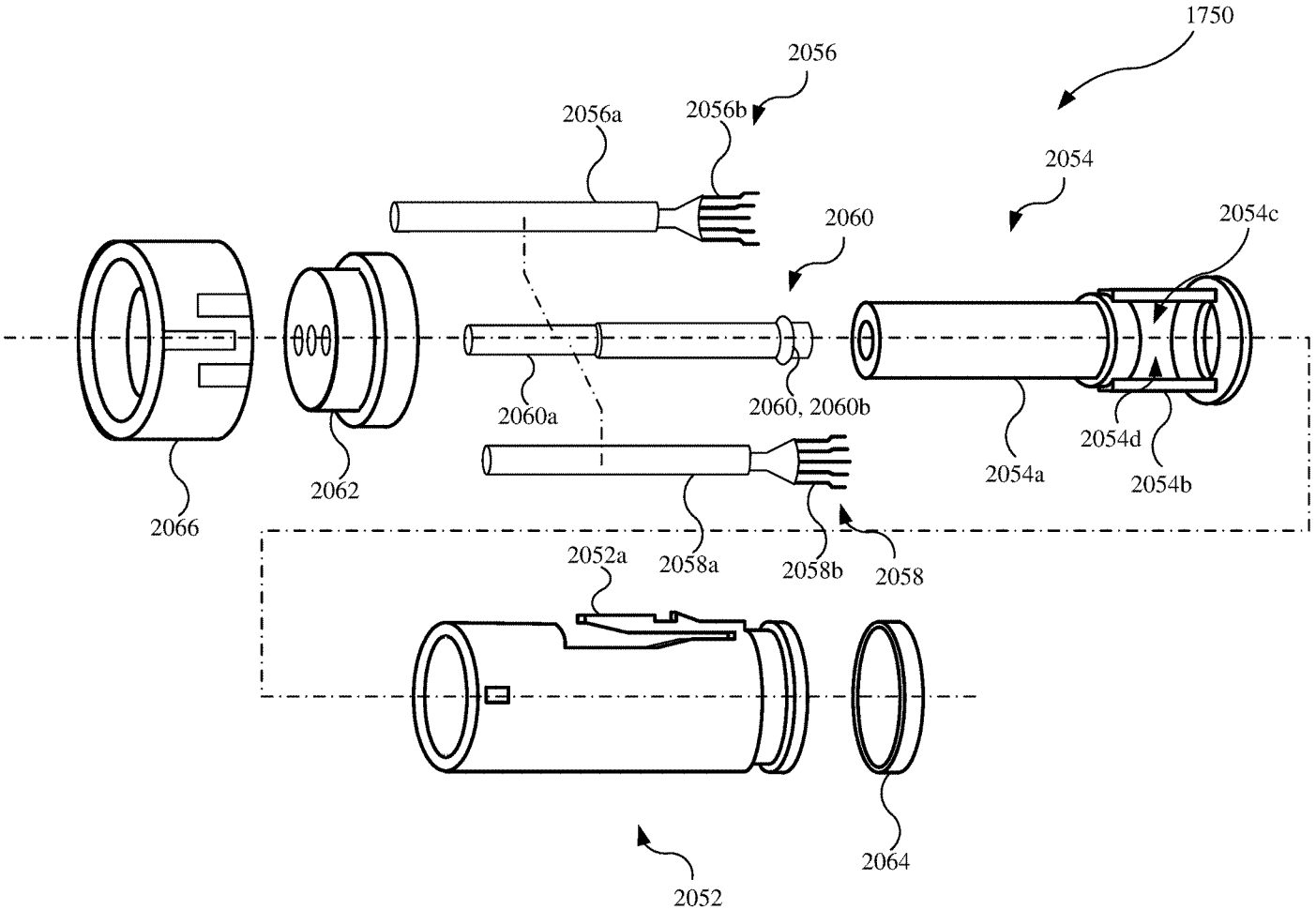
FIG. 20 is an exploded, perspective view of a plug assembly of the connector system of FIG. 17A.
Figure 21A:
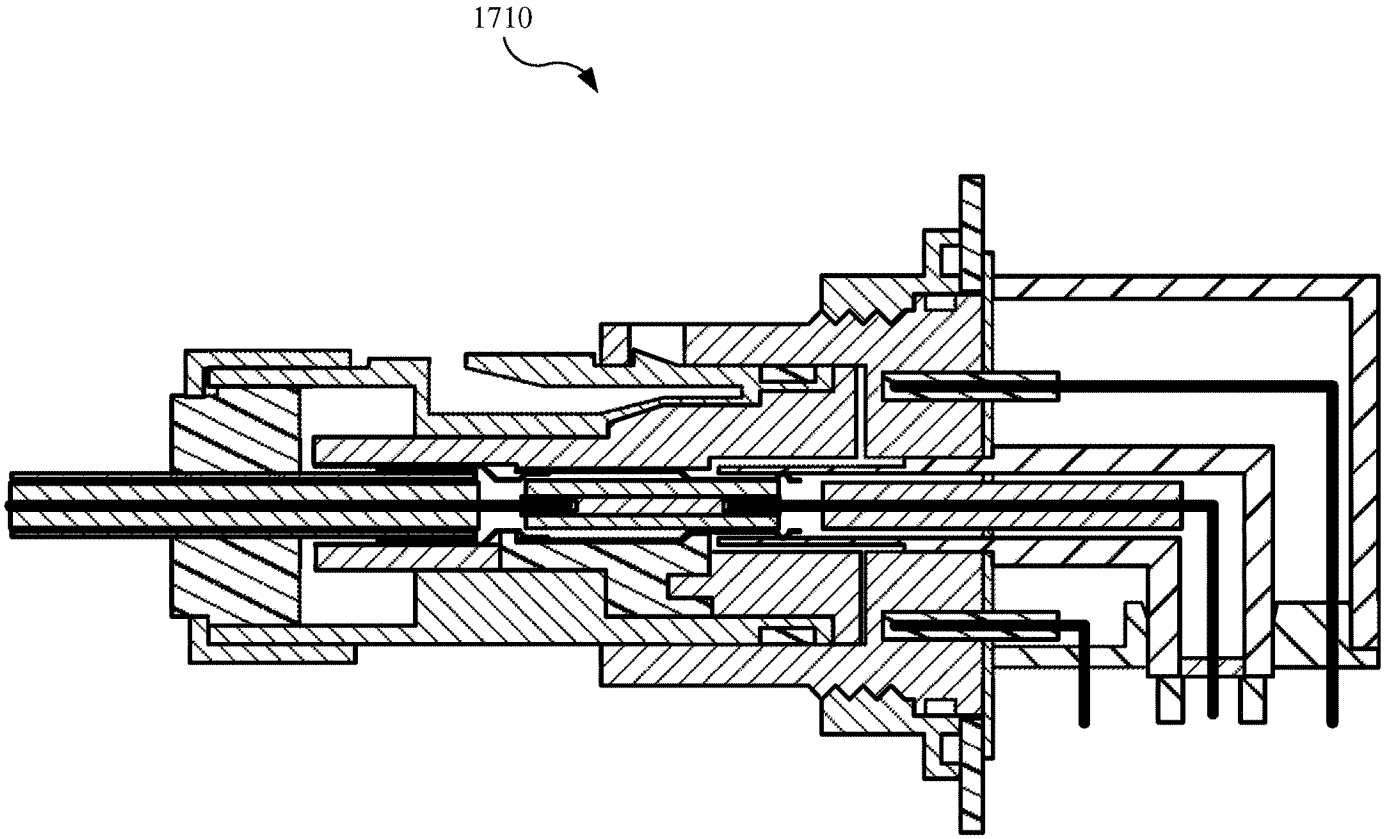
FIG. 21A is a cross-sectional view of the connector system taken along line 21A-21A in FIG. 17A.
Figure 21B:
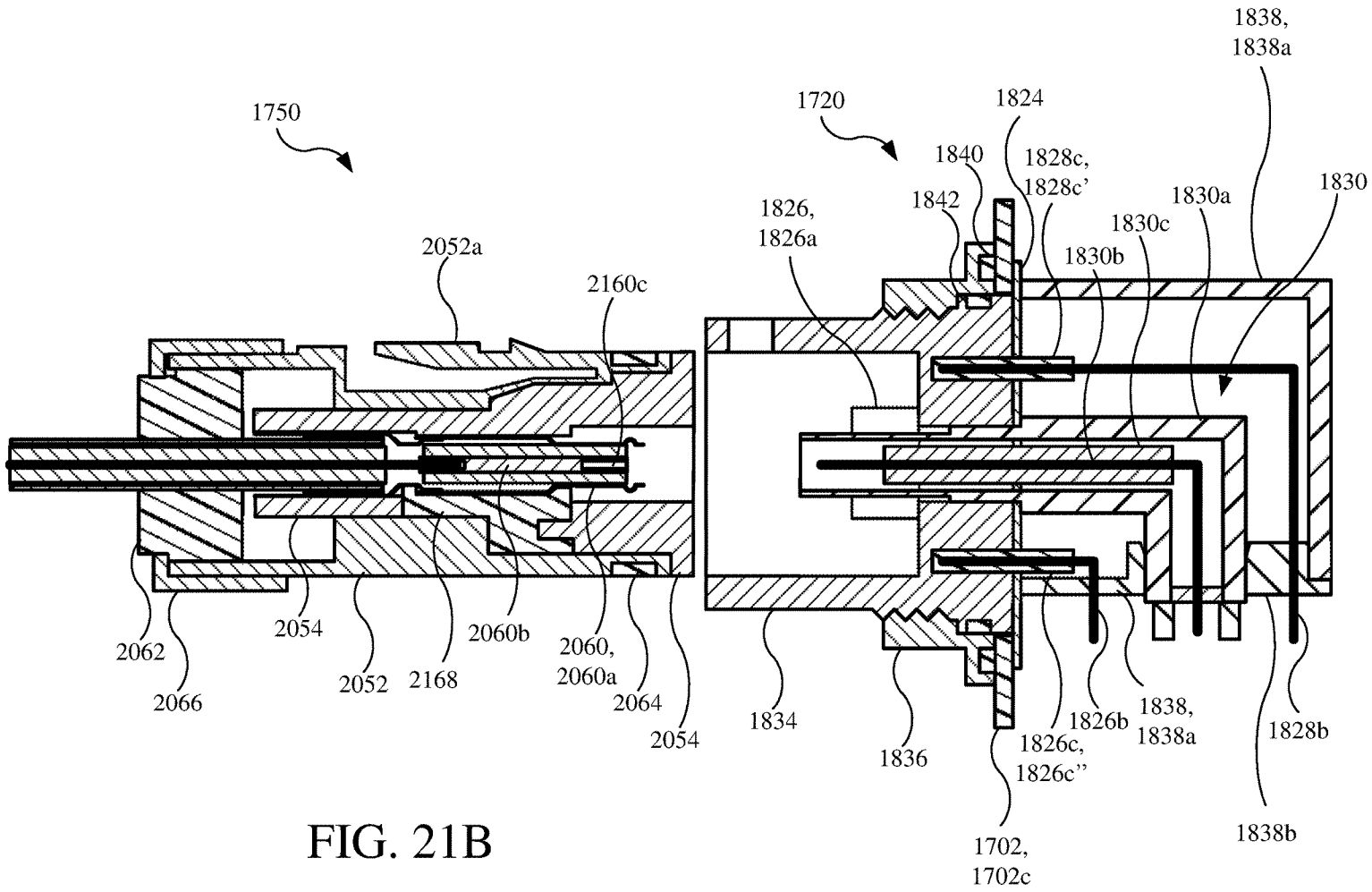
FIG. 21B is a cross-sectional view of the connector system taken along line 21B-21B in FIG. 17B.
Figure 21C:
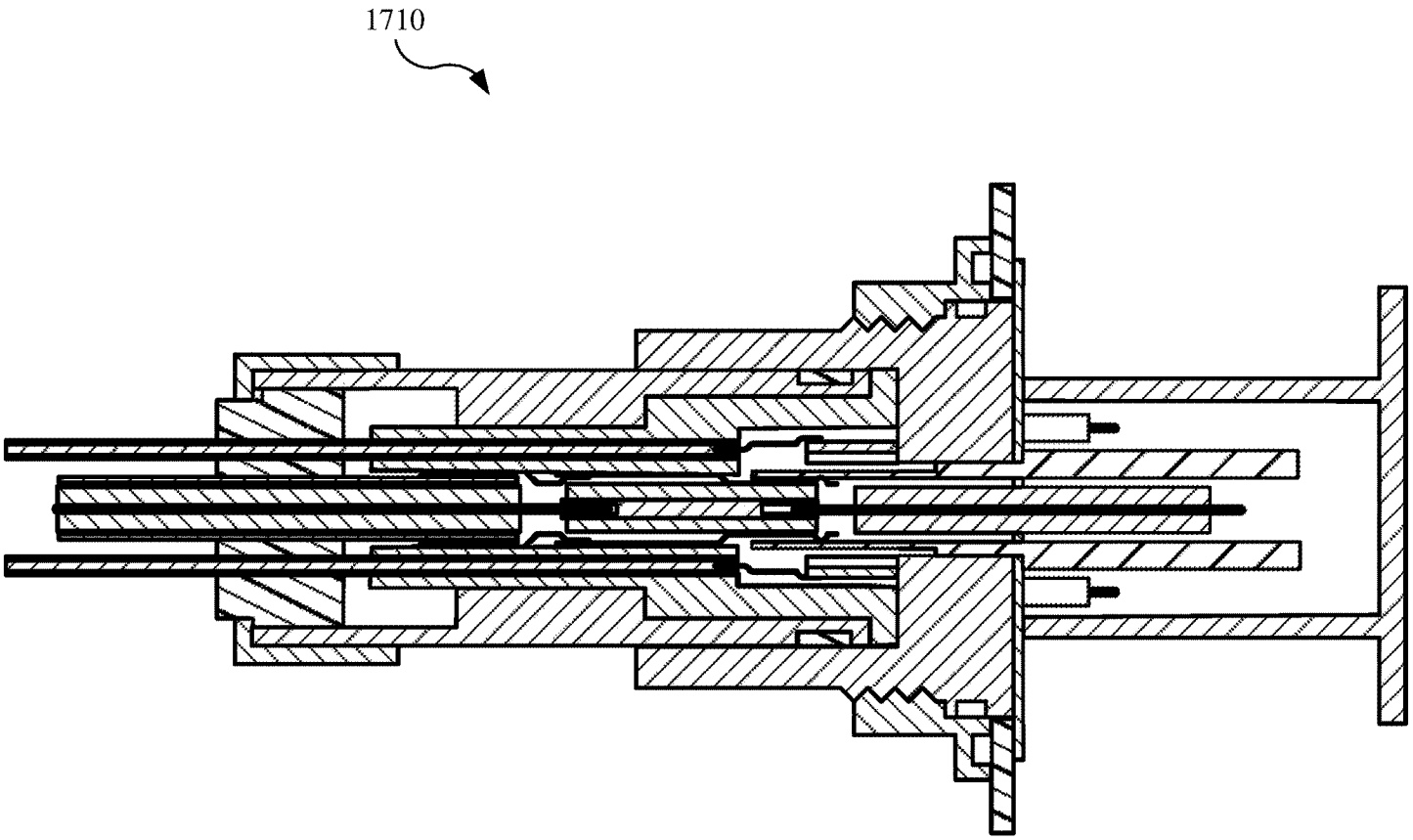
FIG. 21C is a cross-sectional view of the connector system taken along line 21C-21C in FIG. 17A.
Figure 21D:
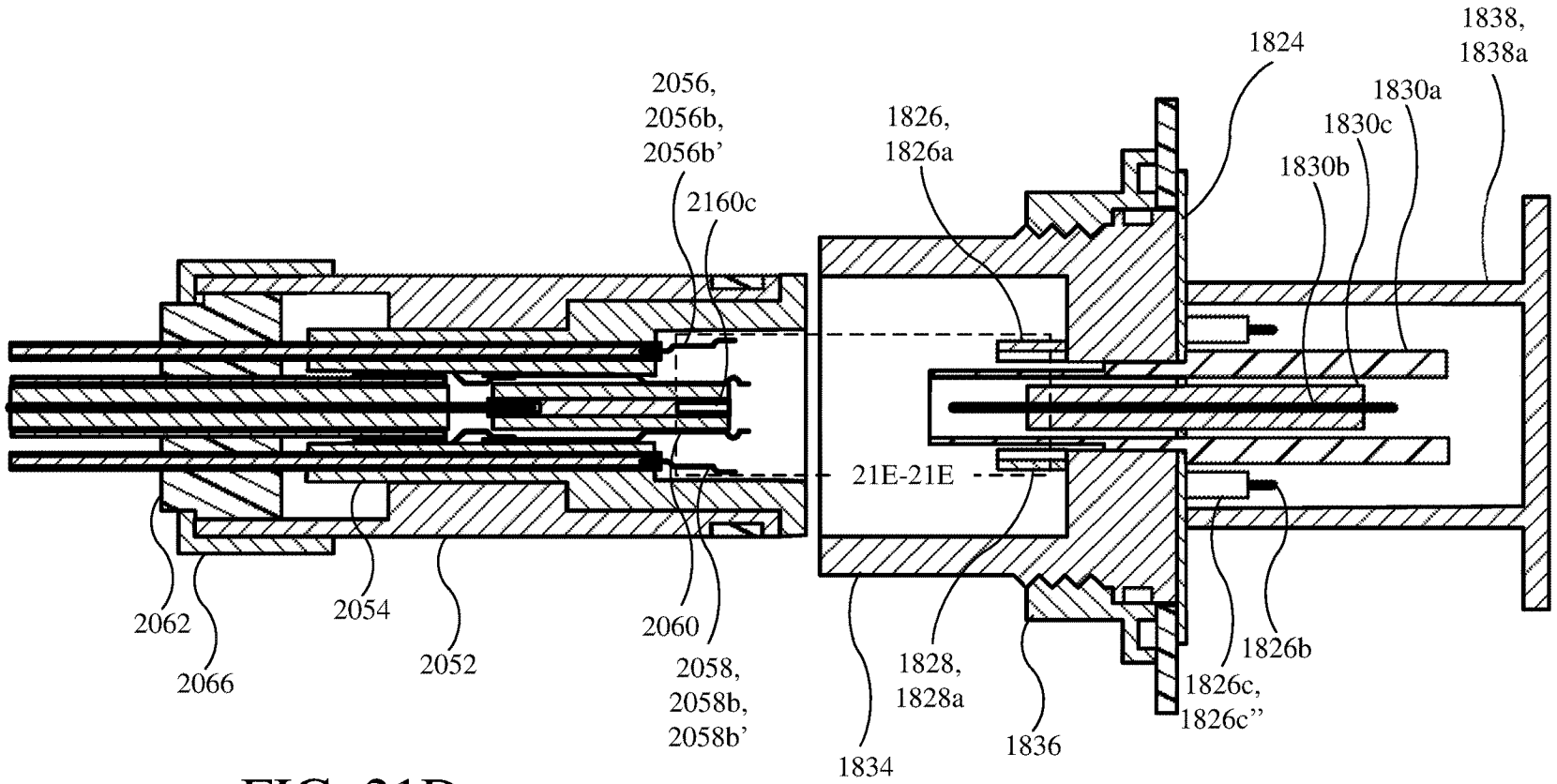
FIG. 21D is a cross-sectional view of the connector system taken along line 21D-21D in FIG. 17B.
Figure 21E:
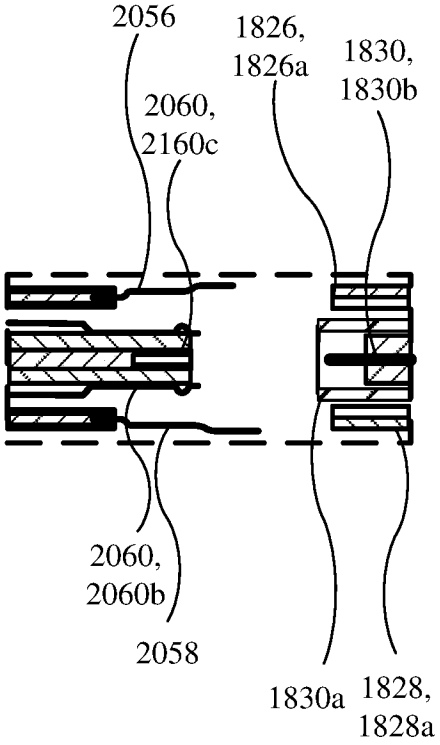
FIG. 21E is a schematic detail view of the connector system taken from box 21E-21E in FIG. 21D.

Referring to FIG. 20, the plug assembly 1750 generally includes an outer housing structure 2052, an inner housing structure 2054, a power contact 2056, a ground contact 2058, a data contact 2060, and wire seal 2062. Generally speaking, the power contact 2056 is configured to electrically connect a power wire 2056*a*, and in particular a single conductor thereof, to the power contact 1826 of the receptacle assembly 1720 (e.g., forming a power pathway). The ground contact 2058 is configured to electrically connect a ground wire 2058*a*, and in particular a single conductor thereof, to the ground contact 1828 of the receptacle assembly 1720 (e.g., forming another power or ground pathway). These single conductors may be stranded or solid, but are to be distinguished from separately insulated wires. The data contact 2060 is configured to electrically connect both a data shield and a data conductor of a data wire to the shield member 1830*a* and the conductor 1830*b* of the data contact 1830. The outer housing structure 2052 and/or the inner housing structure 2054 are mechanically connected to the power contact 2056, the ground contact 2058, and the data contact 2060. The outer housing structure 2052 is further configured be inserted into and engage the receptacle assembly 1720 to retain the plug assembly 1750 therein and seal therewith. The wire seal 2062 is configured to prevent intrusion of contaminants into the plug assembly 1750 and to align the power contact 2056, the ground contact 2058, and the data contact 2060 within the outer housing structure 2052.

The power contact 2056 is connected to a power wire 2056*a*, particularly a single conductor thereof, to conduct electricity therebetween. The power contact 2056 is further configured to physically contact and, thereby, electrically couple to the contact portion 1826*a* of the power contact 1826 in the receptacle assembly 1720. The power contact 2056 includes multiple fingers 2056*b* (e.g., power fingers) that extend generally in an axial direction from the power wire 2056*a*. The fingers 2056*b* are configured to engage the power contact 1826 of the receptacle assembly and flex (e.g., deflect) independent of each other. The fingers 2056*b* form sprung and redundant mechanical engagement with the contact portion 1826*a* of the power contact 1826 to ensure a robust electrical connection. In cross-section, in a proximal region of the power contact 2056, the multiple fingers 2056*b* cooperatively form a transverse arc that is complementary to the curvature of the power contact 1826 of the receptacle assembly 1720. In an intermediate region of the power contact 2056, the fingers 2056*b* may additionally extend radially outward (e.g., flare or taper outward), so as to increase a radius of the transverse arc. In a distal region of the power contact 2056, the fingers 2056*b* may extend axially, such that the transverse arc has a larger radius than in the intermediate region. The fingers 2056*b* are also configured to deflect independent of each other.

As a result of the complementary curvature (i.e., transverse arc), flared distal ends, and independent deflection, the fingers 2056*b* are configured to receive radially therein and physically contact the contact portion 1826*a* of the power contact 1826. The power contact 2056, thereby, electrically connects the power wire 2056*a* to the power contact 1826 of the receptacle assembly 1720.

The power contact may, for example, be made of a copper alloy formed, for example, in a stamping operation. The power contact 2056 is supported by the outer housing structure 2052 and/or the inner housing structure 2054, as will be discussed below, to ensure reliable connection to the power contact 1826 of the receptacle assembly 1720.

The ground contact 2058 is configured substantially similar to the power contact 2056. The ground contact 2058 is connected to a ground wire 2058*a*, particularly a single conductor thereof, and is configured to physically contact and, thereby, electrically couple to the contact portion 1828*a* of the ground contact 1828 in the receptacle assembly 1720. The ground contact 2058 includes multiple fingers 2058*b* (e.g., ground fingers) that extend generally in an axial direction from the ground wire 2058*a*. For further details of the ground contact, including the multiple fingers 2058*b*, refer to discussion of the power contact 2056 above.

As arranged in the plug assembly 1750, the power contact 2056 is arranged radially opposite the ground contact 2058. The power contact 2056 and the ground contact 2058, thereby, define a recess for receiving therein and contacting the power contact 1826 and the ground contact 1828 of the receptacle assembly 1720. In the distal and intermediate regions, the recess defined between the power contact 2056 and the ground contact 2058 may be generally cylindrical and/or frusto-conical to facilitate receipt of the power contact 1826 and the ground contact 1828 therein.

The data contact 2060 is connected to a data wire 2060*a* to conduct data signals therebetween and also connect shielding of the data wire 2060*a* to the shield 1824 and the enclosure 1702. The data wire 2060*a* includes a shield (not labeled) and a dielectric (not labeled) that surround a central conductor (not labeled). The data wire 2060*a* may, for example, form or be connected to the data conductor 561 and the shielding layer 563 of the cable 160. The data wire 2060*a* may, for example, be coax or similar. The data contact 2060 includes a shield contact portion 2060*b* and a data contact portion 2160*c* that are, respectively, electrically connected to the shield and the central conductor of the data wire 2060*a*. The data contact portion 2160*c* may be seen in FIGS. 21A-21D. The shield contact portion 2060*b* and the data contact portion 2160*c* are further configured to physically contact and, thereby, electrically couple to the shield member 1830*a* and the conductor 1830*b* of the data contact 1830 of the receptacle assembly 1720, which thereby form a data pathway for transferring data and a shield pathway (e.g., electrically connecting or grounding the shield of the data wire 2060*a* to the enclosure 1702). The shield contact portion 2060*b* is, for example, received by the shield member 1830*a*. The shield member 1830*a* is, thereby, electrically coupled to the shield plate 1824 and the enclosure 1702. The data contact portion 2160*c* may, for example, receive the conductor 1830*b* of the data contact 1830 of the receptacle assembly 1720 therein.

The inner housing structure 2054 is mechanically connected to the power contact 2056, the ground contact 2058, and the data contact 2060, so as to facilitate contact with the power contact 1826, the ground contact 1828, and the data contact 1830, respectively, of the receptacle assembly 1720 when inserted therein. The inner housing structure 2054 is a generally annular member having a proximal portion 2054*a* and a distal portion 2054*b*. The proximal portion 2054*a* is generally configured to couple to and/or otherwise support the power contact 2056, the ground contact 2058, and the data contact 2060. The distal portion 2054*b* defines a recess 2054*c* in which the power contact 2056, the ground contact 2058, and the data contact 2060 are positioned, and in which the power contact 1826, the ground contact 1828, and the data contact 1830 of the receptacle assembly 1720 are received.

Furthermore, the power contact 2056, the ground contact 2058, and the data contact 2060 of the plug assembly 1750 may be cooperatively configured with the power contact 1826, the ground contact 1828, and the data contact 1830 of the receptacle assembly 1720 to facilitate electrical connections being performed in a particular order or sequence. For example, as the plug assembly 1750 is inserted into the receptacle assembly 1720, the ground contacts 2058, 1828 first connect with each other, then the power contacts 2056, 1826 connect with each other, then the data contacts 2060, 1830 connect with each other. This ordered sequence of connections may be to ensure proper power sequencing and/or to prevent effects of arcing and electrostatic discharge. Conversely, when the plug assembly 1750 is removed, the data contacts 2060, 1830 first disconnect from each other, then the power contacts 2056, 1826 disconnect from each other, then the ground contacts 2058, 1828 disconnect from each other. Such ordered or sequenced connections may be facilitated, for example, by the respective lengths of the contacts. Referring to the schematic detail view of FIG. 21E, for example, prior to connection (e.g., when the plug assembly 1750 is partially inserted into the receptacle assembly 1720), the ground contacts 2058, 1828 are in closer axial proximity to each other than are the power contacts 2056, 1826, and the power contacts 2056, 1826 are in closer axial proximity to each other than the data contacts 2060, 1830.

The proximal portion 2054*a* of the inner housing structure 2054 defines a bore through which the data wire 2060*a* and the data contact 2060 extend. The data contact 2060 is, further, supported by the proximal portion 2054*a* to be suspended in the distal portion 2054*b* for connection to the data contact 1830 of the receptacle assembly 1720.

The power wire 2056*a* and the ground wire 2058*a* extend parallel with the proximal portion 2054*a* and are positioned radially opposite each other. The power wire 2056*a* and the ground wire 2058*a* may, for example, form or be coupled to the conductors 568 of the cable 160. The power contact 2056 and the ground contact 2058 may each be connected and/or otherwise supported by the inner housing structure 2054. The distal portion 2054*b* additionally includes apertures 2054*d* in which the fingers 2056*b* of the power contact 2056 and the fingers 2058*b* of the ground contact 2058 are arranged to engage the power contact 1826 and the ground contact 1828 when received in the recess thereof.

The inner housing structure 2054 is, for example, an injection molded polymer (e.g., polyamide) member, but may be made according to other manufacturing processes and/or different suitable materials.

The outer housing structure 2052 is a generally tubular structure (e.g., annular). The outer housing structure 2052 surrounds and contains therein the inner housing structure 2054, as well as the power contact 2056, the ground contact 2058, and the data contact 2060. The outer housing structure 2052 is configured to be inserted into the primary recess 1734*a* and releasably connect and seal to the primary housing structure 1834 of the receptacle assembly 1720. For example, the outer housing structure 2052 may include a sprung lever 2052*a* that engages the locking feature 1834*a* of the primary housing structure 1834 of the receptacle assembly 1720. A gasket 2064 (e.g., a polymer O-ring) may also be arranged and compressed radially between the outer housing structure 2052 of the plug assembly 1750 and the primary housing structure 1834 to form the seal therebetween.

The outer housing structure 2052 is, for example, an injection molded polymer (e.g., polyamide) member, but may be made according to other manufacturing processes and/or different suitable materials.

The wire seal 2062 is configured to support the power wire 2056*a*, the ground wire 2058*a*, and the data wire 2060*a* in a proximal end of the outer housing structure 2052. The wire seal 2062 additionally forms a seal with the outer housing structure 2052 and/or the inner housing structure 2054, as well as forms seals with the power wire 2056*a*, the ground wire 2058*a*, and the data wire 2060*a* extending axially therethrough. The wire seal 2062 is, for example, an injection molded elastomeric component.

The plug assembly 1750 may additionally include a housing cover 2066, which is received over the distal end of the outer housing structure 2052. The housing cover 2066 is coupled to the outer housing structure 2052 (e.g., with snap-fit arrangement) to retain the wire seal 2062 therein.

The plug assembly 1750 may additionally include a terminal position assurance member 2168, which is arranged radially between the inner housing structure 2054 and the outer housing structure 2052. The terminal assurance member 2168 is a structure, which may function to align and/or support the power contact 2056 and the ground contact 2058 in proper positions in the plug assembly 1750.

What is claimed is:

1. A connector system for transferring electricity and data signals, the connector system comprising:

a receptacle comprising a shield, a power contact, a ground contact, and a data contact, wherein the shield provides electromagnetic shielding and includes one or more power apertures through which the power contact extends, one or more ground apertures through which the ground contact extends, and a data aperture through which a shield member and a data conductor of the data contact extend; and a plug comprising another power contact connected to a power wire conductor, another ground contact connected to a ground wire conductor, and another data contact, wherein the plug is selectively receivable by the receptacle to electrically connect the power wire conductor to the power contact of the receptacle, to electrically connect the ground wire conductor to the ground contact of the receptacle, and to electrically connect the data contact to the other data contact.

2. The connector system according to claim 1, wherein the shield is connectable to an enclosure containing one or more electrical components to which the electricity and the data signals are transferable.

3. The connector system according to claim 2, further comprising the enclosure.

4. The connector system according to claim 2, wherein a cable is connected to the plug and includes a data conductor and a shielding layer, and when the plug is received by the receptacle to electrically connect the data contact to the other data contact, the shielding layer is electrically connected to the shield member to form a shield pathway from the shielding layer to the enclosure.

5. The connector system according to claim 2, wherein when the plug is received by the receptacle, a seal is formed between the plug and the receptacle.

6. The connector system according to claim 5, wherein the plug includes a gasket that is compressed between the plug and the receptacle to form the seal, and the seal prevents water intrusion into the enclosure.

7. The connector system according to claim 1, wherein the power contact is positioned radially opposite the ground contact, and the data contact extends axially between the power contact and the ground contact.

8. The connector system according to claim 1, wherein the shield includes two or more of the power apertures and two or more of the ground apertures;

wherein the power contact includes two or more power conductor segments, one of the power conductor segments extending through each one of the power apertures; and wherein the ground contact includes two or more ground conductor segments, one of the ground conductor segments extending through each one of the ground apertures.

9. The connector system according to claim 8, wherein the power contact includes a power contact portion that engages the other power contact of the plug, and the power conductor segments conduct electricity from the power contact portion through the shield, the power contact portion and the power conductor segments forming a singular conductive member; and wherein the ground contact includes a ground contact portion that engages the other ground contact of the plug, and the ground conductor segments conduct electricity from the power contact portion through the shield, the ground contact portion and the ground conductor segments forming another singular conductive member.

10. The connector system according to claim 9, wherein the other power contact of the plug includes power fingers that engage the power contact portion of the receptacle and that flex independent of each other; and wherein the other ground contact of the plug includes ground fingers that engage the ground contact portion of the receptacle and that flex independent of each other.

11. The connector system according to claim 8, wherein the power apertures are arranged in a first group, the ground apertures are arranged in a second group, and the data aperture is arranged between the first group and the second group.

12. The connector system according to claim 11, wherein the power conductor segments extend through the shield parallel with the ground conductor segments in an axial direction.

13. The connector system according to claim 1, wherein the shield is connectable to an enclosure containing one or more electrical components to which the electricity and the data signals are transferable;

wherein a cable is connected to the plug and includes a data conductor and a shielding layer, and when the plug is received by the receptacle, a shield pathway is formed from the shielding layer to the enclosure;

wherein when the plug is received by the receptacle, a seal is formed between the plug and the receptacle by a gasket that is compressed therebetween to prevent water intrusion into the enclosure;

wherein the shield includes two or more of the power apertures and two or more of the ground apertures, the power contact includes two or more power conductor segments with one of the power conductor segments extending through each one of the power apertures, and the ground contact includes two or more ground conductor segments with one of the ground conductor segments extending through each one of the ground apertures;

wherein the power contact includes a power contact portion that engages the other power contact of the plug, and the power conductor segments conduct electricity from the power contact portion through the shield, and wherein the ground contact includes a ground contact portion that engages the other ground contact of the plug, and the ground conductor segments conduct electricity from the power contact portion through the shield; and wherein the other power contact of the plug includes power fingers that engage the power contact portion of the receptacle and that flex independent of each other, and the other ground contact of the plug includes ground fingers that engage the ground contact portion of the receptacle and that flex independent of each other.

14. The connector system according to claim 1, wherein the shield is formed by an electromagnetic shield structure having a rear shield structure and a peripheral shield structure extending forward from the rear shield structure, and the one or more power apertures, the one or more ground apertures, and the data aperture extend through the rear shield structure.

15. The connector system according to claim 14, wherein the electromagnetic shield structure further includes a forward shield structure electrically connected to the peripheral shield structure substantially continuously therearound, such that the electromagnetic shield structure surrounds the power contact and the ground contact and receives the other power contact and the other ground contact of the plug therein.

16. The connector system according to claim 15, wherein the receptacle includes a body member contained within the electromagnetic shield structure, and the body member receives the plug to form a seal therewith.

17. A connector system for transferring electricity and data comprising:

a receptacle assembly including a housing, a shield plate, a power contact, a ground contact, and a data contact, wherein the shield plate provides electromagnetic shielding, is connected to the housing, and includes multiple power apertures through which the power contact extends, multiple ground apertures through which the ground contact extends, and a data aperture through which the data contact extends;

a plug assembly including another housing, another power contact, another ground contact, and another power contact in the other housing, the plug assembly being receivable by the receptacle assembly to form a seal therebetween and to electrically connect the other power contact to the power contact, the other ground contact to the ground contact, and the other data contact to the data contact;

wherein the receptacle assembly is configured to connect to an electromagnetic shield enclosure to form a seal therewith and to electrically connect the shield plate thereto.

18. The connector system according to claim 17, wherein the receptacle assembly is configured to couple to the electromagnetic shield enclosure by extending through an enclosure aperture of the enclosure with the shield plate contacting the enclosure entirely around the enclosure aperture.

19. The connector system according to claim 18, wherein the seal is formed by compressing a seal member between the housing and the electromagnetic shield enclosure, the seal member being positioned radially outward of the enclosure aperture.

20. The connector system according to claim 17, wherein the power contact includes three power conductor segments and the shield plate includes three power apertures through which the power conductor segments extend, and the ground contact includes three ground conductor segments and the shield plate includes three ground apertures through which the ground conductor segments extend.

21. A connector system for providing power and data coupling, comprising:

a cable having a data conductor, a shielding layer, a first power conductor, and a second power conductor;

a plug connector mechanically coupled to the cable and comprising a first data terminal electrically coupled to the data conductor, a first annular member electrically coupled to the shielding layer, a first power terminal electrically coupled to the first power conductor, a second power terminal electrically coupled to the second power conductor, and an outer annular member, wherein the first annular member is positioned radially between the first power terminal and the second power terminal, the first data terminal is positioned within the first annular member, and the outer annular member surrounds the first data terminal, the first annular member, the first power terminal, and the second power terminal; and a base configured to receive the plug connector, the base comprising a shield structure providing electromagnetic shielding and defining a cavity in which are positioned a second data terminal, a second annular member, a third power terminal, and a fourth power terminal, which are configured to electrically couple to the first data terminal, the first annular member, the first power terminal, and the second power terminal of the plug connector, respectively;

wherein the base further comprises a body in the cavity of the shield structure, and the body defines a recess for receiving the plug connector to seal therewith and in which are positioned the second data terminal, the second annular member, the third power terminal, and the fourth power terminal, the recess receiving and having a larger diameter than the outer annular member of the plug connector.

22. The connector system according to claim 21, wherein the base includes a front plate electrically coupled to a forward edge of the shield structure and extending laterally outward therefrom.

23. The connector system according to claim 22, wherein the shield structure is recessed into and electrically connected to an enclosure.

24. The connector system according to claim 8, wherein the power contact includes overmolded portions that surround the power conductor segments to prevent conductive contact with the shield, and ground contact includes other overmolded portions that surround the ground conductor segments to prevent conductive contact with the shield.

25. The connector system according to claim 10, wherein the power contact portion and the ground contact portion are positioned radially opposite each other and each form a portion of a cylindrical surface.

26. The connector system according to claim 20, wherein the power contact includes a power contact portion formed as a singular conductive member with the three power conductor segments, and the ground contact includes a ground contact portion formed as another singular conductive member with the three ground conductor segments.

27. The connector system according to claim 23, wherein the front plate is sealed with the body.

* * * * *